US010307893B2

(12) United States Patent
Costen

(10) Patent No.: US 10,307,893 B2
(45) Date of Patent: Jun. 4, 2019

(54) CLAMPING APPARATUS AND METHOD

(71) Applicant: Michael Costen, Milford, CT (US)

(72) Inventor: Michael Costen, Milford, CT (US)

(73) Assignee: DIMIDE, INC., Milford, CT (US)

( * ) Notice: Subject to any disclaimer, the term of this patent is extended or adjusted under 35 U.S.C. 154(b) by 0 days.

(21) Appl. No.: 15/355,853

(22) Filed: Nov. 18, 2016

(65) Prior Publication Data

US 2017/0216996 A1 Aug. 3, 2017

Related U.S. Application Data

(60) Provisional application No. 62/289,487, filed on Feb. 1, 2016, provisional application No. 62/266,822, filed on Dec. 14, 2015.

(51) Int. Cl.
*B25B 5/10* (2006.01)

(52) U.S. Cl.
CPC ..... *B25B 5/101* (2013.01); *B25B 5/103* (2013.01)

(58) Field of Classification Search
USPC ..... 269/243, 221, 220, 237, 242
See application file for complete search history.

(56) References Cited

U.S. PATENT DOCUMENTS 1,318,934 A 10/1919 Thompson
2,899,995 A 8/1959 Lampe
2,901,012 A * 8/1959 Crispin ..... B23Q 11/0003 269/218
3,428,306 A 2/1969 Harrison
3,575,405 A 4/1971 Harding
3,736,629 A * 6/1973 Blake ..... B25B 5/103 24/514
3,909,889 A 10/1975 Emerson
(Continued)

FOREIGN PATENT DOCUMENTS

CN 204195570 3/2015
GB 575458 2/1946

OTHER PUBLICATIONS

International Search Report and Written Opinion (dated Mar. 13, 2017) for International Application No. PCT/US2016/66285—filing date Dec. 13, 2016.

(Continued)

*Primary Examiner* — Joseph J Hail
*Assistant Examiner* — Shantese McDonald
(74) *Attorney, Agent, or Firm* — Schmeiser, Olsen Watts, LLP

(57) ABSTRACT

Disclosed herein is a clamping apparatus that includes an upper jaw structure having a hinge end and a clamp end, a lower jaw structure having a hinge end and a clamp end, and a hinge located at the hinge ends of the upper and lower jaw structures, the hinge providing for rotation of upper jaw structure with respect to the lower jaw structure. The clamping apparatus includes an elongated element threadably attached to the first and second upper jaw structures between the hinge end and the clamp end of each of the first and second upper jaw structures, wherein rotation of the elongated element in a first direction causes the clamp end of the upper jaw structure to move closer to the clamp end of the lower jaw structure. The elongated element includes an end configured to receive a tool configured to facilitate the rotation of the elongated element.

22 Claims, 32 Drawing Sheets

(56) References Cited

U.S. PATENT DOCUMENTS

| | | | | |
|---|---|---|---|---|
| 4,183,512 | A | 1/1980 | Goff et al. | |
| 4,221,419 | A | 9/1980 | Riley et al. | |
| 4,258,908 | A | 3/1981 | Goff et al. | |
| 4,278,246 | A * | 7/1981 | Blake | B25B 5/103 269/220 |
| 4,619,447 | A | 10/1986 | Blake | |
| 4,669,170 | A * | 6/1987 | Blake | B25B 5/103 29/257 |
| 4,823,636 | A | 4/1989 | Suska | |
| 5,230,150 | A | 7/1993 | Sperti | |
| 5,809,623 | A | 9/1998 | Dykstra | |
| 6,739,068 | B1 | 5/2004 | Rinner | |
| 6,893,012 | B2 | 5/2005 | Wong | |
| 8,794,612 | B2 | 8/2014 | Chuang | |

OTHER PUBLICATIONS

International Search Report and Written Opinion (dated Mar. 13, 2017) for International Patent Application No. PCT/US2016/66285 filed Dec. 12, 2016—27 pages.

* cited by examiner

CLAMPING APPARATUS AND METHOD

RELATED MATTERS

This application is a nonprovisional patent application which claims priority to U.S. Provisional Application No. 62/266,822, filed Dec. 14, 2015, entitled "Clamping Apparatus and Method," and U.S. Provisional Application No. 62/289,487, filed on Feb. 1, 2016 entitled "Clamping Apparatus and Method," the disclosures of which being herein incorporated by reference.

FIELD OF TECHNOLOGY

The subject matter disclosed herein relates generally to clamps. More particularly, the subject matter relates to a high strength and high speed clamp.

BACKGROUND

Existing clamps are limited in strength relative to the size and dimensions of the clamp. Many clamps are difficult to compress or clamp, especially when they are designed for high strength applications. Moreover, clamps designed for high strength applications are also difficult to compress or clamp at high speeds. Rather, high strength clamps often have very slow tightening processes. Moreover, safety concerns and clamp strength concerns preclude existing clamps from being compressed or clamped with facilitation from power tools.

Thus, a clamp which has higher speed and/or higher strength would be well received in the art.

BRIEF DESCRIPTION

According to one embodiment, a clamping apparatus comprises: an upper jaw structure having a hinge end and a clamp end; a lower jaw structure having a hinge end and a clamp end; a hinge located at the hinge ends of the upper and lower jaw structures, the hinge providing for rotation of upper jaw structure with respect to the lower jaw structure; and an elongated element threadably attached to the first and second upper jaw structures between the hinge end and the clamp end of each of the first and second upper jaw structures, wherein rotation of the elongated element in a first direction causes the clamp end of the upper jaw structure to move closer to the clamp end of the lower jaw structure, wherein the elongated element includes an end having a hexagonal shape configured to receive a tool configured to facilitate the rotation of the elongated element, the tool selected from the group consisting of a hand wrench, an impact wrench, and a ratchet.

According to another embodiment, a clamping apparatus comprises: a first upper jaw having a hinge end and a clamp end; a second upper jaw having a hinge end and a clamp end, the second upper jaw fixedly coupled to the first upper jaw such that the second upper jaw is spaced apart from the first upper jaw; a first lower jaw having a hinge end and a clamp end; a second lower jaw having a hinge end and a clamp end, the second lower jaw fixedly coupled to the first lower jaw such that the second lower jaw is spaced apart from the first lower jaw; a hinge located at the hinge ends of the first and second upper jaws and the first and second lower jaws, the hinge providing for rotation of the first and second upper jaws with respect to the first and second lower jaws; a first internal plate located between and attached to at least one of: each of the first upper jaw and the second upper jaw; and each of the first lower jaw and the second lower jaw; and an elongated element threadably attached to the first and second upper jaws between the hinge end and the clamp end of each of the first and second upper jaws, the elongated element threadably attached to the first and second lower jaws between the hinge end and the clamp end of each of the first and second lower jaws, wherein rotation of the elongated element in a first direction causes the clamp ends of the first and second upper jaws to move closer to the clamp ends of the first and second lower jaws.

According to another embodiment, a clamping apparatus comprises: an upper jaw structure having a hinge end and a clamp end; a lower jaw structure having a hinge end and a clamp end; a hinge located at the hinge ends of the upper and lower jaw structures, the hinge providing for rotation of the first and second upper jaws with respect to the first and second lower jaws; an elongated element threadably attached to the first and second upper jaw structures between the hinge end and the clamp end of each of the first and second upper jaw structures, wherein rotation of the elongated element in a first direction causes the clamp end of the upper jaw structure to move closer to the clamp end of the lower jaw structure, wherein at least one of the upper jaw structure and the lower jaw structure includes a C-shaped profile that widens in a middle, wherein if the C-shaped profile is included in the upper jaw structure: a curved inner edge of the C-shaped profile includes a center of curvature located farther from the lower jaw structure than the curved inner edge of the C-shaped profile, and wherein if the C-shaped profile is included in the lower jaw structure: a curved inner edge of the C-shaped profile includes a center of curvature located farther from the upper jaw structure than the curved inner edge of the C-shaped profile.

BRIEF DESCRIPTION OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings in which:

DETAILED DESCRIPTION

Figure 1:
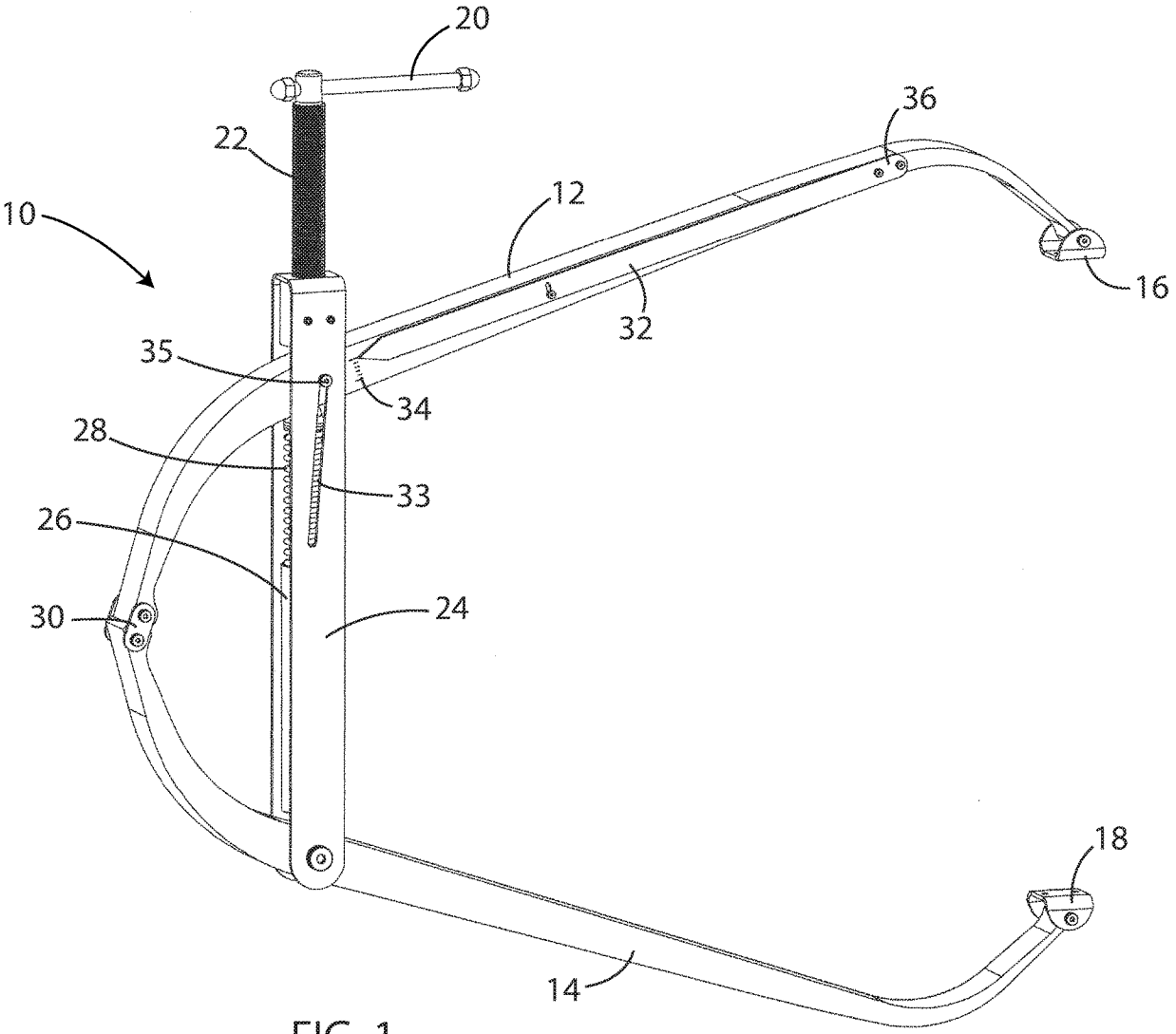
FIG. 1 depicts a perspective view of a clamp in an open state in accordance with one embodiment.
Figure 2:
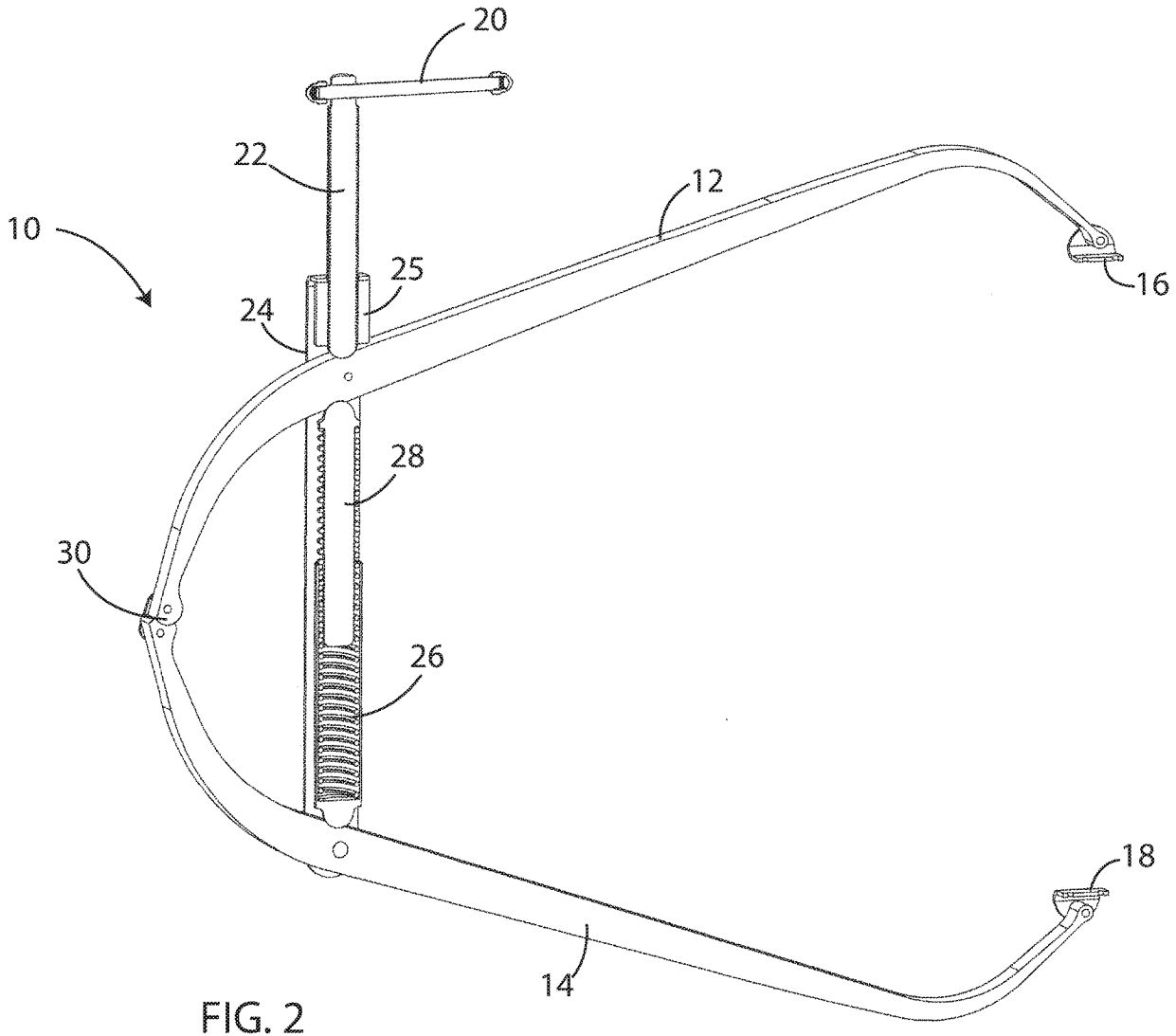
FIG. 2 depicts a cross sectional view of the clamp of FIG. 1 in an open state in accordance with one embodiment.
Figure 3:
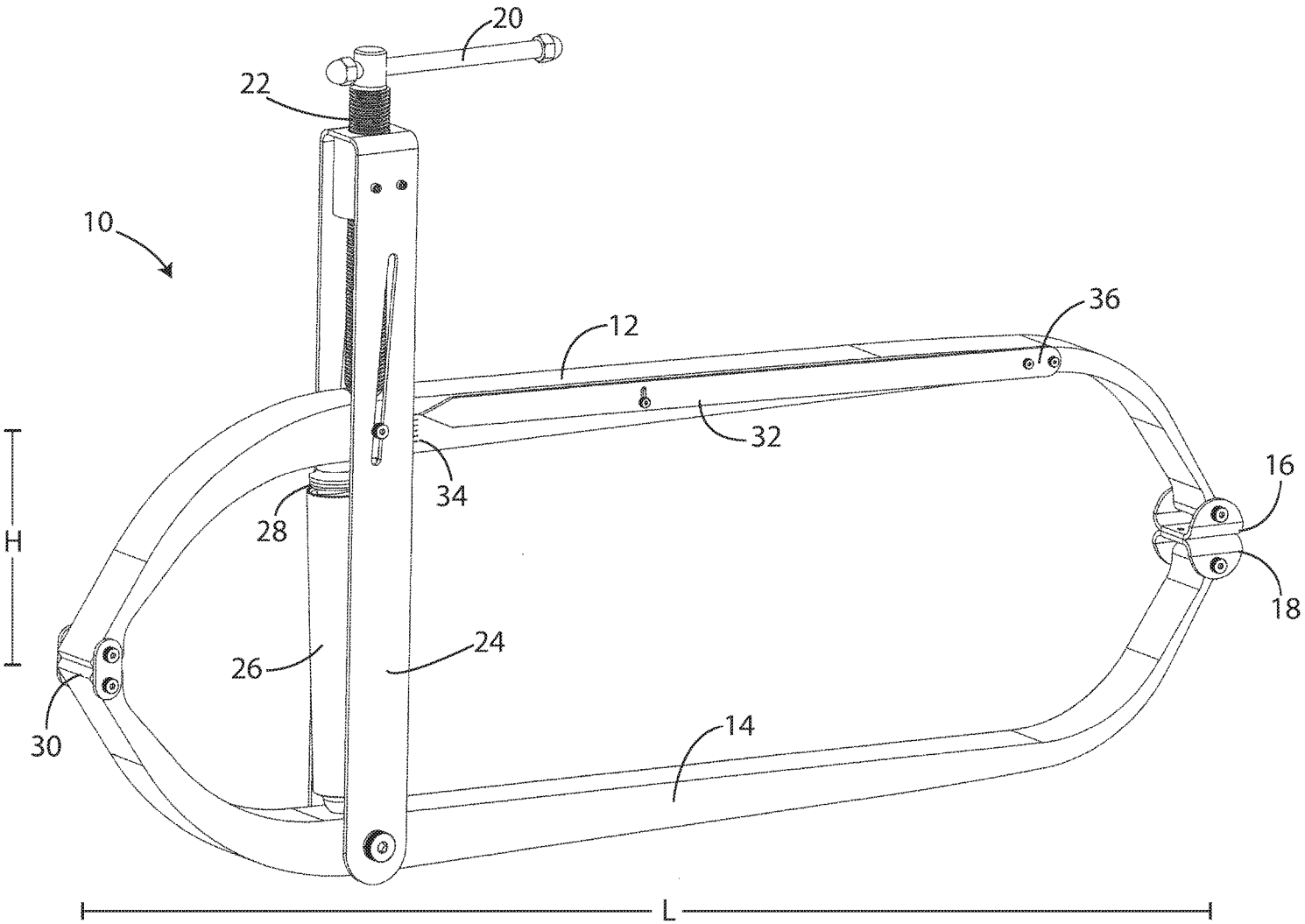
FIG. 3 depicts a perspective view of the clamp of FIGS. 1-2 in a closed state in accordance with one embodiment.
Figure 4:
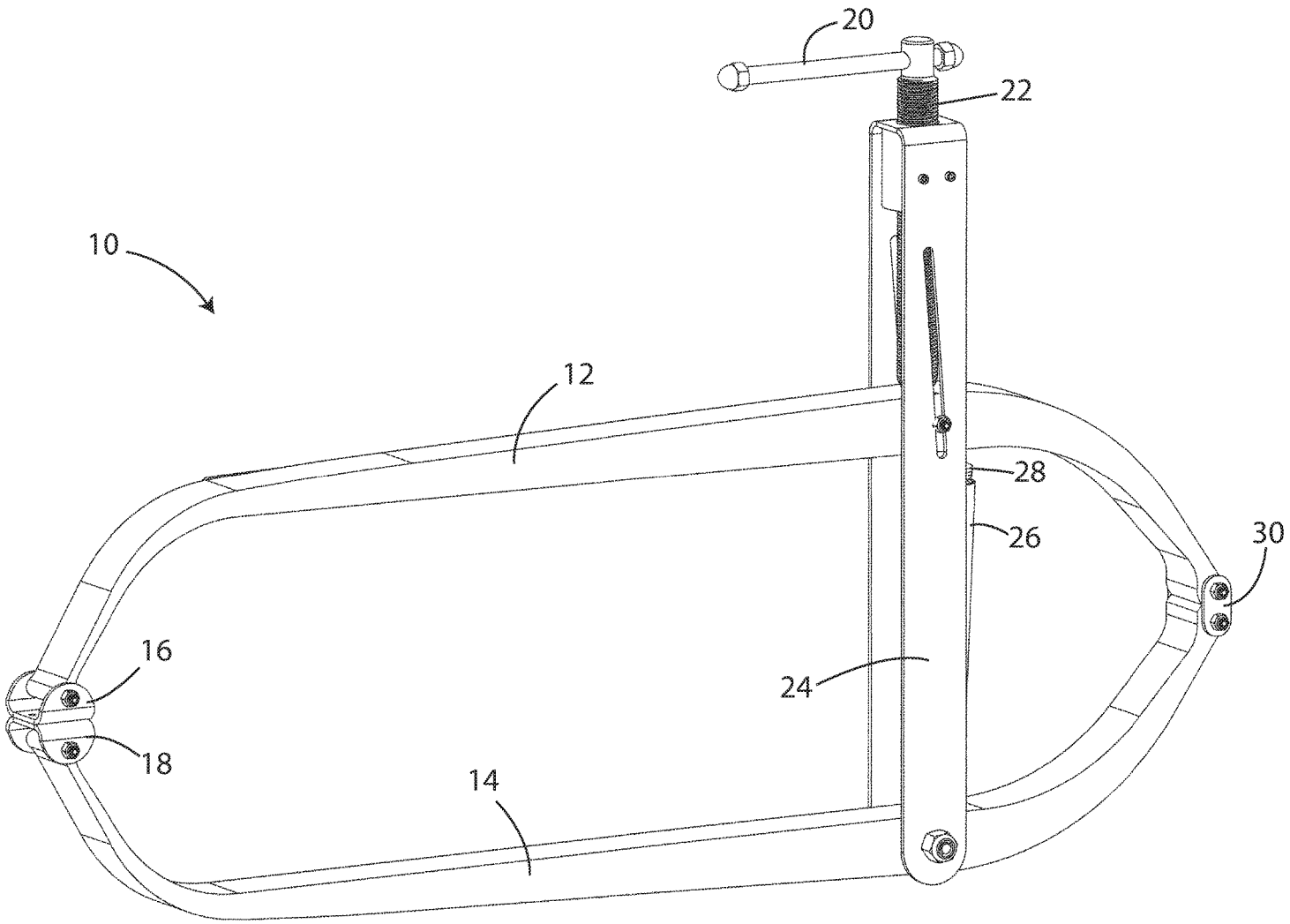
FIG. 4 depicts a perspective view of an opposite side of the clamp of FIGS. 1-3 in a closed state in accordance with one embodiment.
Figure 5:
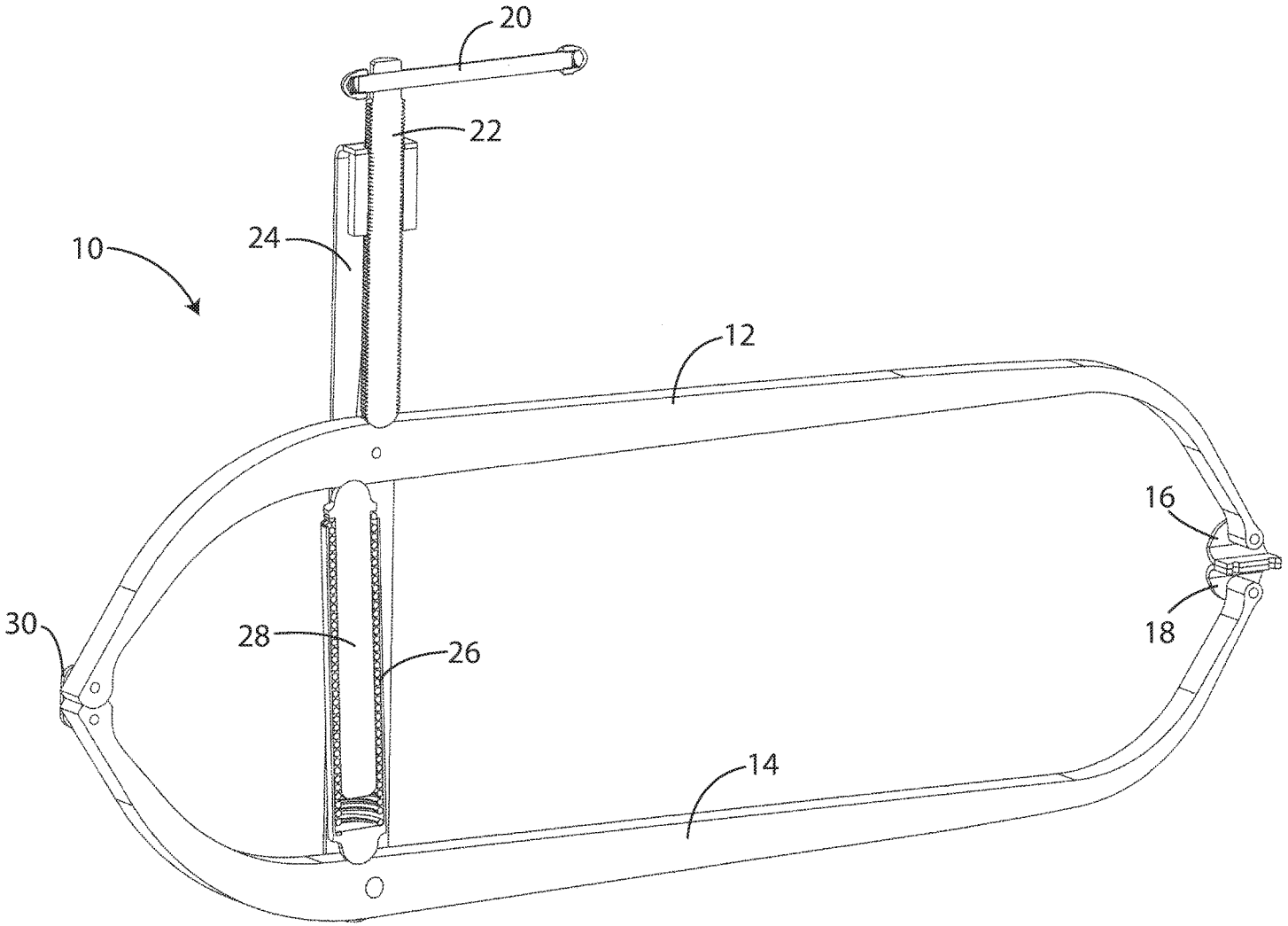
FIG. 5 depicts a cross sectional view of the clamp of FIGS. 1-4 in a closed state in accordance with one embodiment.

A detailed description of the hereinafter described embodiments of the disclosed apparatus and method are presented herein by way of exemplification and not limitation with reference to the Figures.

A first embodiment of a clamp 10 is shown in FIGS. 1-7 having a first jaw 12 and a second jaw 14. The first and second jaws 12, 14 are attached in a pivotable manner at a hinge 30 located at a first end of the first and second jaws 12, 14. The first and second jaws 12, 14 may have a horizontal length L between its ends that may be between two, three, four or even five or more times their vertical height H. The first jaw 12 may include a first clamping jaw member 16 providing a clamping surface from which to clamp an object. The second jaw 14 may include a second clamping jaw member 18 providing a second clamping surface from which to clamp the object there between.

The clamp 10 may include a clamping mechanism 24 including a housing attached to an outside of each of the first and second jaws 12, 14. The clamping mechanism 24 may be located proximate the first end located at the hinge 30. The clamping mechanism 24 may exert a clamping force on the first and second jaws 12, 14, to move the first and second clamping jaw members 16, 18 into a clamped state. The clamping mechanism 24 may include a spring biasing element 28 that is configured to put a constant anti-clamping force between the first and second jaws 12, 14. The spring biasing element 28 may be upwardly biased against the first jaw 12 by a spring element 26. The clamping mechanism 24 may include a receiving element 25 located above the first jaw 12 for threadably receiving a drive screw 22. The drive screw 22 may be turnable by a handle 20 in order to clamp the first and second jaws 12, 14 together.

The housing of the clamping mechanism 24 may include a vertical opening 33 through which a pin 35 may extend. The pin 35 may slide along the vertical opening 33 as the drive screw 22 is driven into the top first jaw 12 during clamping. The vertical opening 33 may be disposed on the housing of the clamping mechanism 24 in a slightly diagonal angle which may ensure the spring biasing element 28 and the drive screw 22 remain properly positioned against the first jaw 12.

Figure 6:
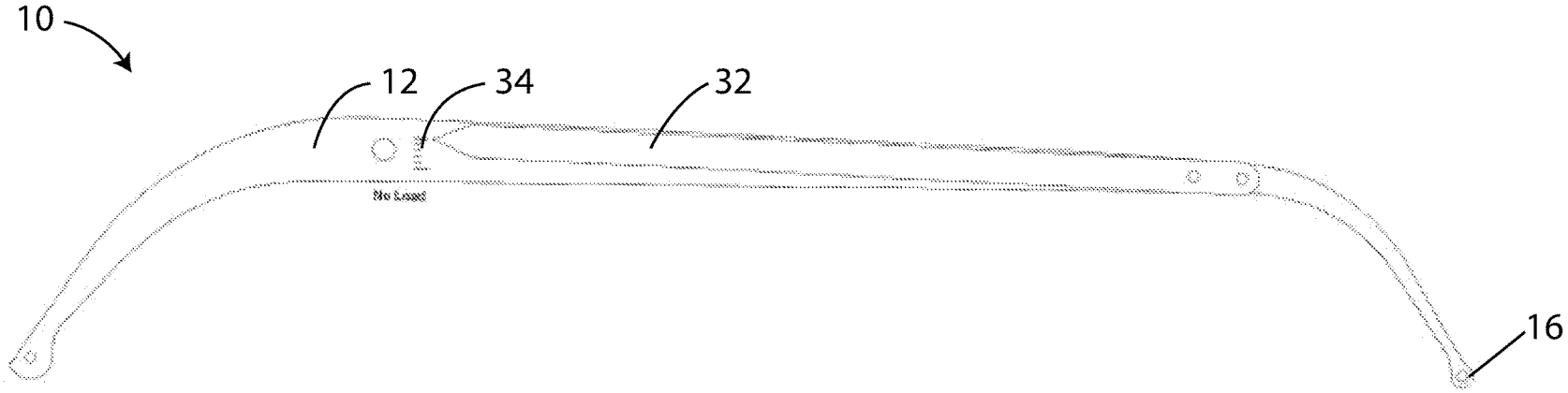
FIG. 6 depicts a side view of a clamp load gauge of the clamp of FIGS. 1-5 in accordance with one embodiment.
Figure 7:
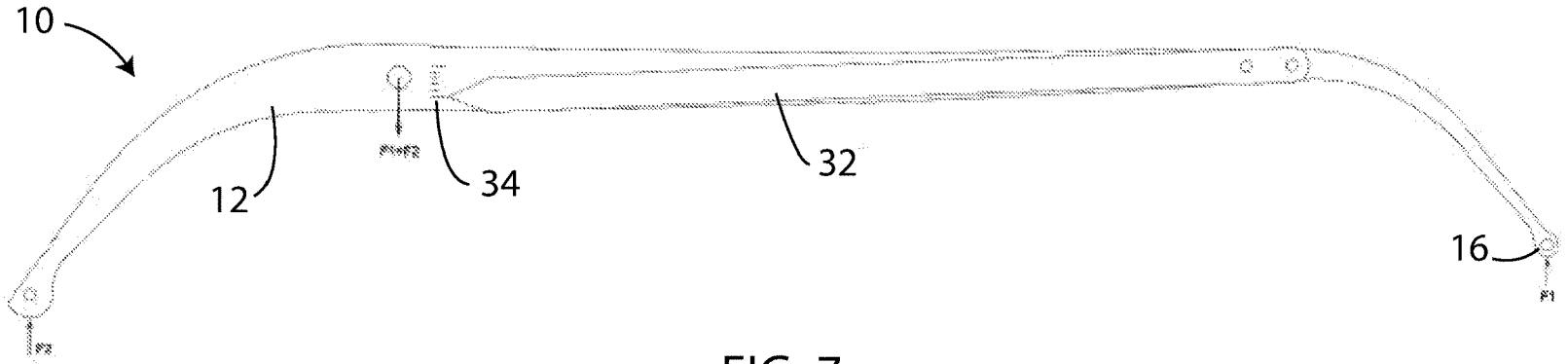
FIG. 7 depicts another side view of the clamp load gauge of FIG. 6 in accordance with one embodiment.

The clamp 10 may further include a load gauge 32. The load gauge 32 may be located on the top jaw 12 in the manner shown in the Figures. Alternatively, the load gauge 32 may be located on the bottom jaw 14 in a similar manner. The load gauge 32 may be configured to determine load by measuring the flex in the jaw 12, 14 upon which it is attached. The load gauge 32 may be attached at one end 36 of the jaw 12 in the embodiment shown. The load gauge 32 may include measuring indicia 34. A pointed end of the gauge 32 may be directed at the measuring indicia 34 in order to determine the load on the clamps 12, 14. For example, the maximum load position is shown in FIG. 7 while a no-load position is shown in FIG. 6.

In one embodiment, the distance between the clamping end 16, 18 and the clamping mechanism 24 (i.e. the clamping reach) may be over 8 inches while the maximum clamping load may be at least 1250 pounds at the clamping end 16, 18. In some embodiments, the clamp 10 may include a clamping reach of 10 inches or more. The longer the clamping reach, the wider the device that may be clamped between the jaws 12, 14 may be. The clamp 10 may be made of a particularly stiff material that is resistant to permanent deformation in order to provide for such a large clamping reach with simultaneously high clamping loads. For example, materials such as High Low Alloy Steel (e.g. ASTM A514) or other like materials may be utilized.

Figure 8:
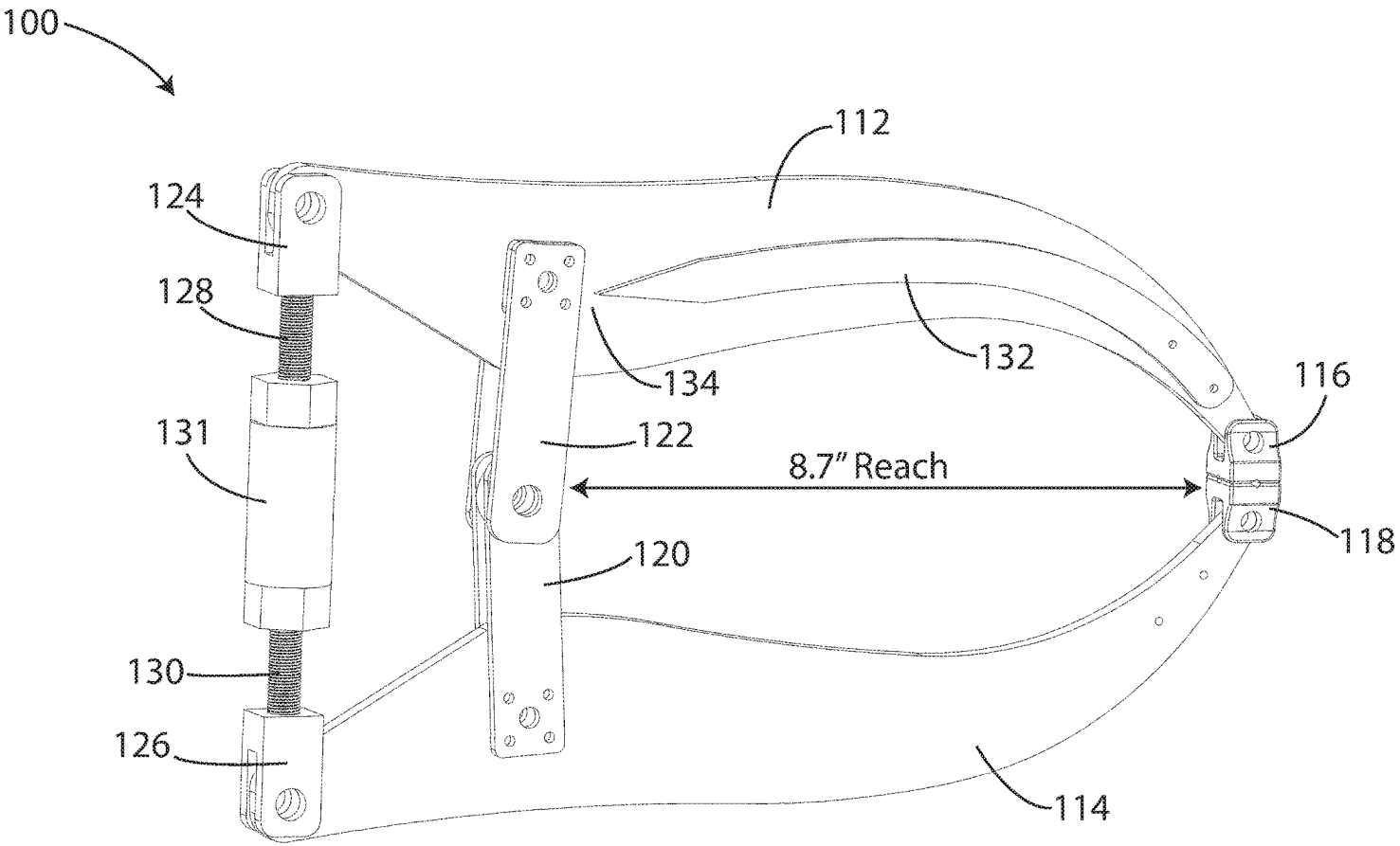
FIG. 8 depicts a perspective view of another clamp in a closed state in accordance with one embodiment.
Figure 9:
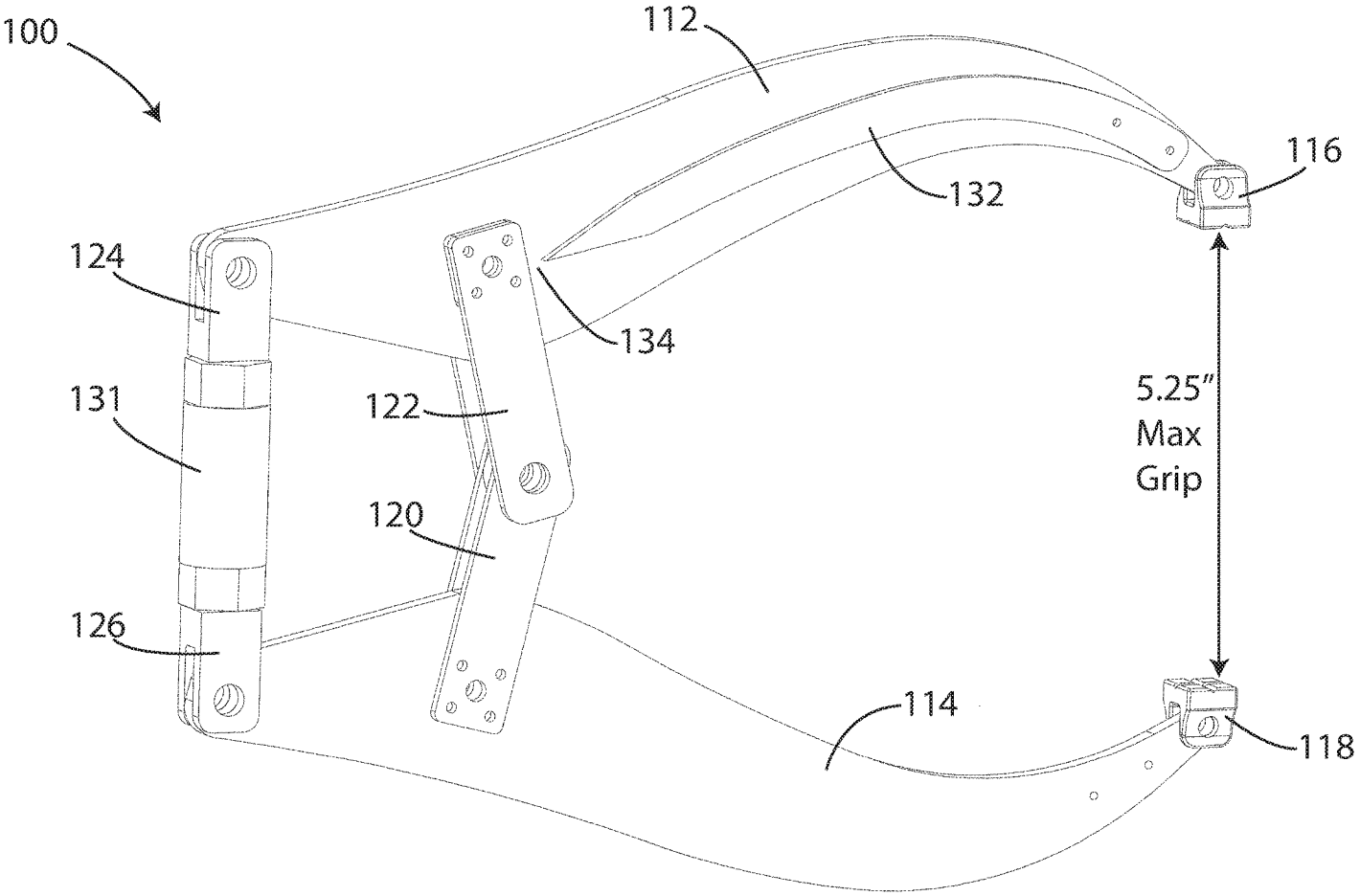
FIG. 9 depicts a perspective view of the clamp of FIG. 8 in an open state in accordance with one embodiment.

Referring now to FIGS. 8-9, another clamp 100 is shown according to another embodiment. The clamp 100 may include a similarly large clamping reach as the embodiment shown in FIGS. 1-7 and may include a first jaw 112 and a second jaw 114 made of similar materials as the first and second jaws 12, 14 described hereinabove. While the embodiment shown includes a clamp reach of 8.7" and a max grip of 5.26", these dimensions are exemplary and may be greater or smaller depending on the embodiment.

Unlike the clamp 10 described hereinabove, the clamp 100 may include a turnbuckle drive 131 for driving the first and second jaws 112, 114 together rather than the clamping mechanism 24. The turnbuckle drive 131 may be quickly turned in order to expand the threaded elongated elements 128, 130 which are attached to the first and second jaws 112, 114, respectively, at the rotatable attachment elements 124, 126. The first jaw 112 may include extension plates 122 extending toward the second jaw 114. The second jaw 114 may include similar extension plates 120 extending toward the first jaw 112. The extension plates 120, 122 may be connected at a rotation point about which the first and second jaws 112, 114 may be configured to rotate. The extension plates 120, 122 may extend from a midpoint of the first and second jaws 112, 114, proximately closer to the end having the turnbuckle drive 131 and not the clamping end having the first and second clamping elements 116, 118. Similar to the clamp 10, the clamp 100 may include a load gauge 132 which may come to a point 134 which may point to indicia (not shown) located on the jaw 112 configured to determine the load at the clamp 116, 118.

Figure 10:
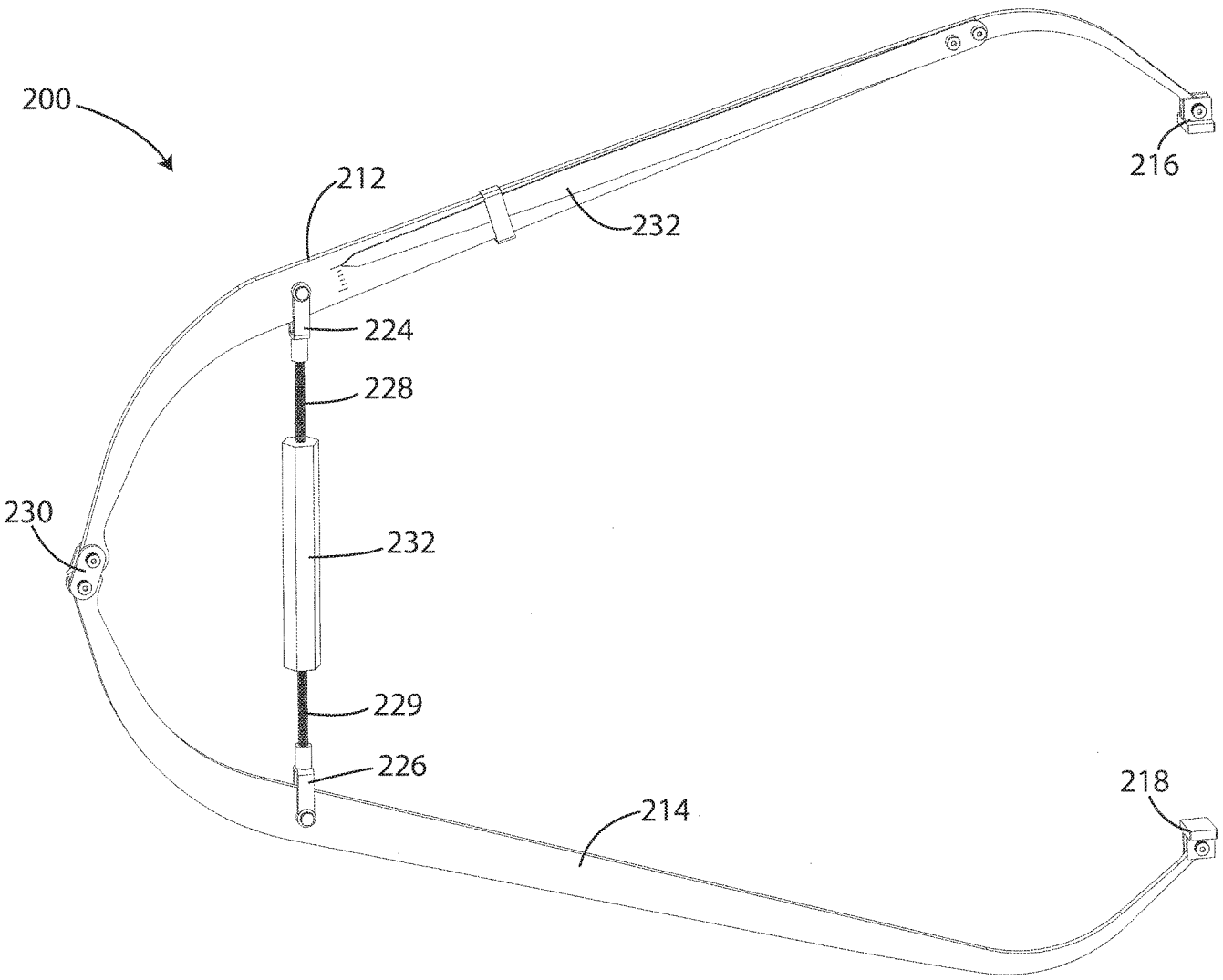
FIG. 10 depicts a perspective view of another clamp in an open state in accordance with one embodiment.

Referring now to FIG. 10, another clamp 200 is shown. The clamp 200 may include a similarly large clamping reach as the embodiment shown in FIGS. 1-7 and may include a first jaw 212 and a second jaw 214 made of similar materials as the first and second jaws 12, 14 described hereinabove. Further, the clamp 200 may include a hinge 230 located at a first end of each of the first and second jaws 212, 214. Similar to the clamp 10, the clamp 200 may include a load gauge 232 pointed at indicia located on the upper first jaw 212. The clamping jaws 212, 214 may further each include clamping ends 216, 218, respectively.

Unlike the clamp 10, the clamp 200 may include a turnbuckle drive 232 extending between the first and second jaws 212, 214 at a mid-point along the first and second jaws 212, 214 proximate the end with the hinge 230. The turnbuckle drive 232 may include rotatable attachment mechanisms 224, 226 for attaching threaded elongated elements 228, 229 respectively. The turnbuckle drive 232 may be configured to expand and contract the threaded elongated elements 228, 229. In clamp 200, the turnbuckle drive may be a tension curing load application. As a result, the buckling stabilization features may not be necessary. Otherwise the turnbuckle provides the same benefits as in clamp 100.

Figure 11:
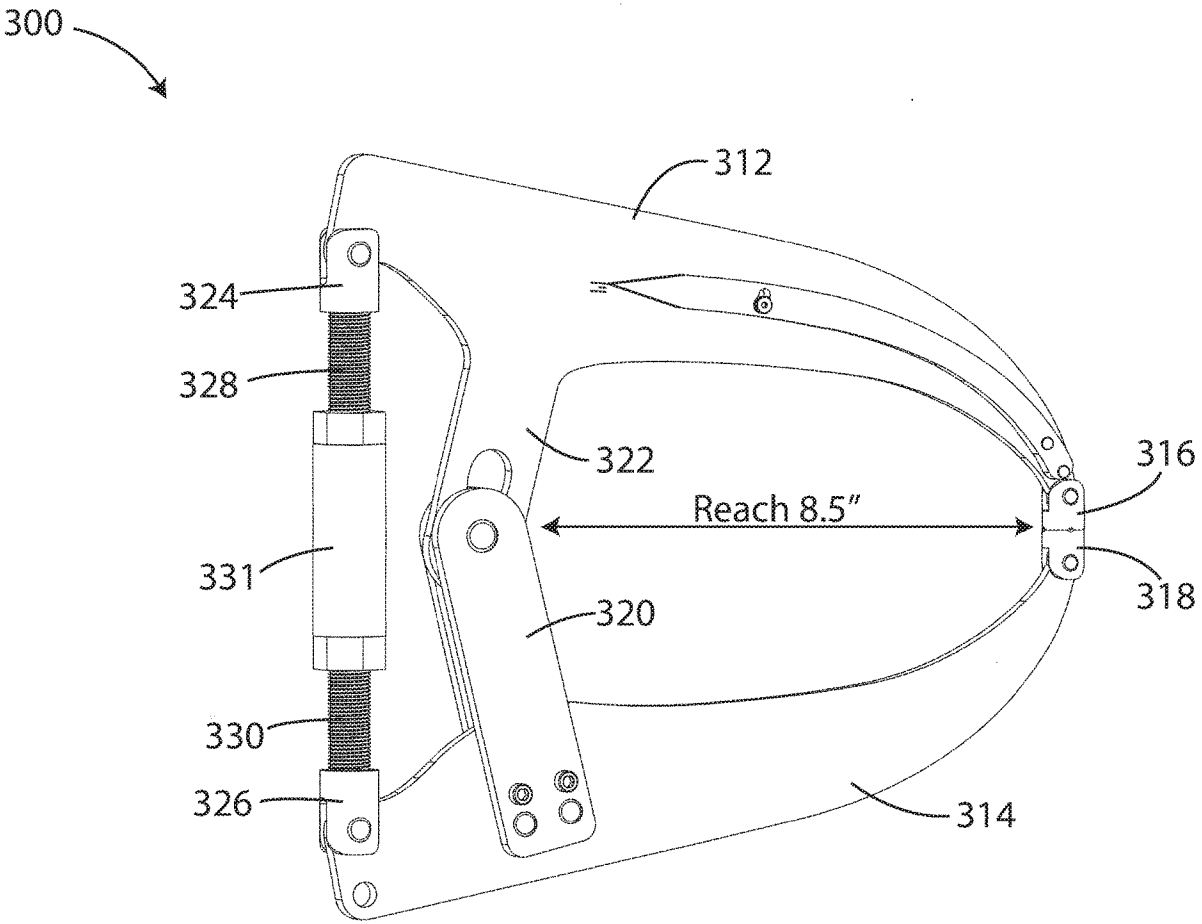
FIG. 11 depicts a perspective view of another clamp in a closed state in accordance with one embodiment.
Figure 12:
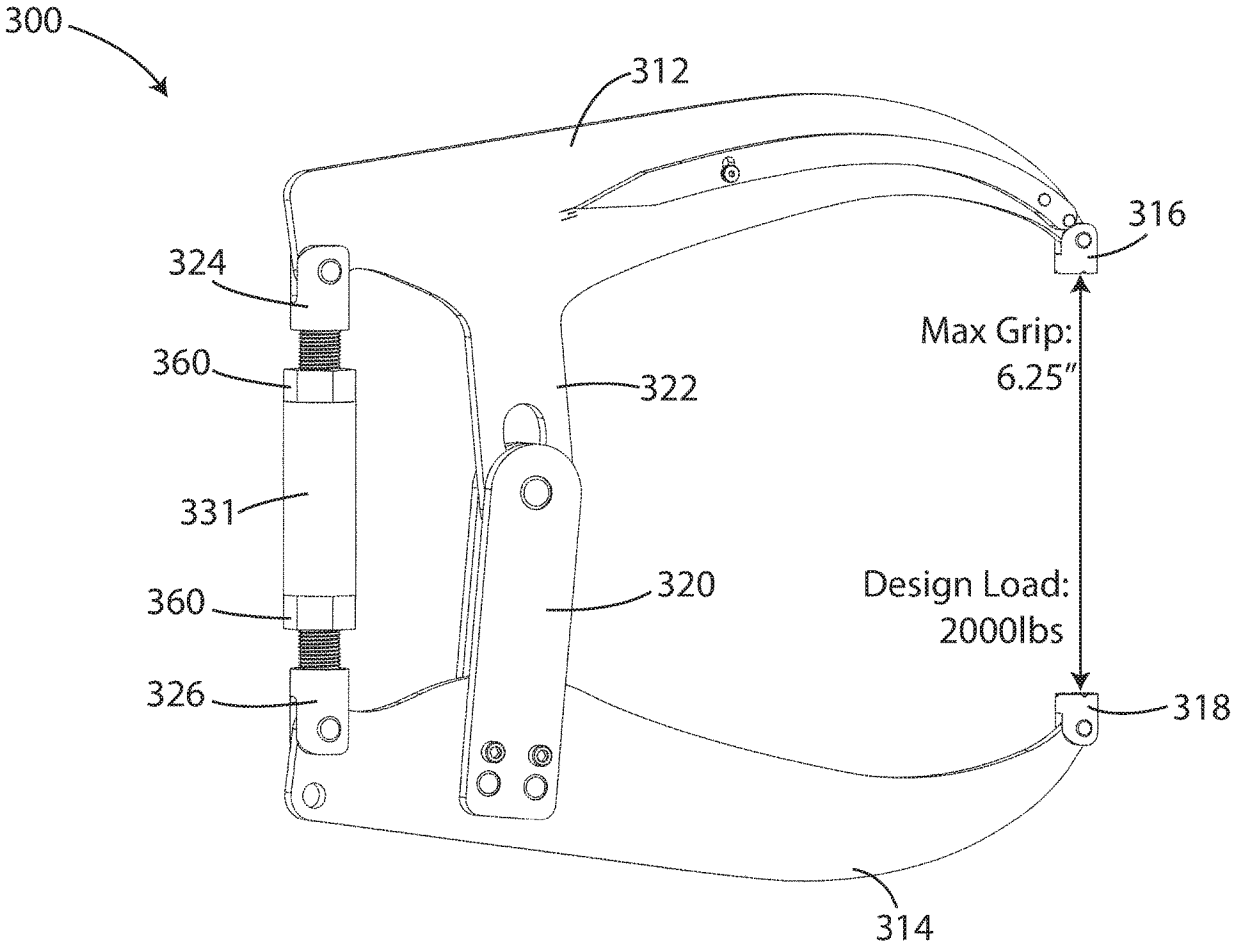
FIG. 12 depicts a perspective view of the clamp of FIG. 12 in an open state in accordance with one embodiment.
Figure 13:
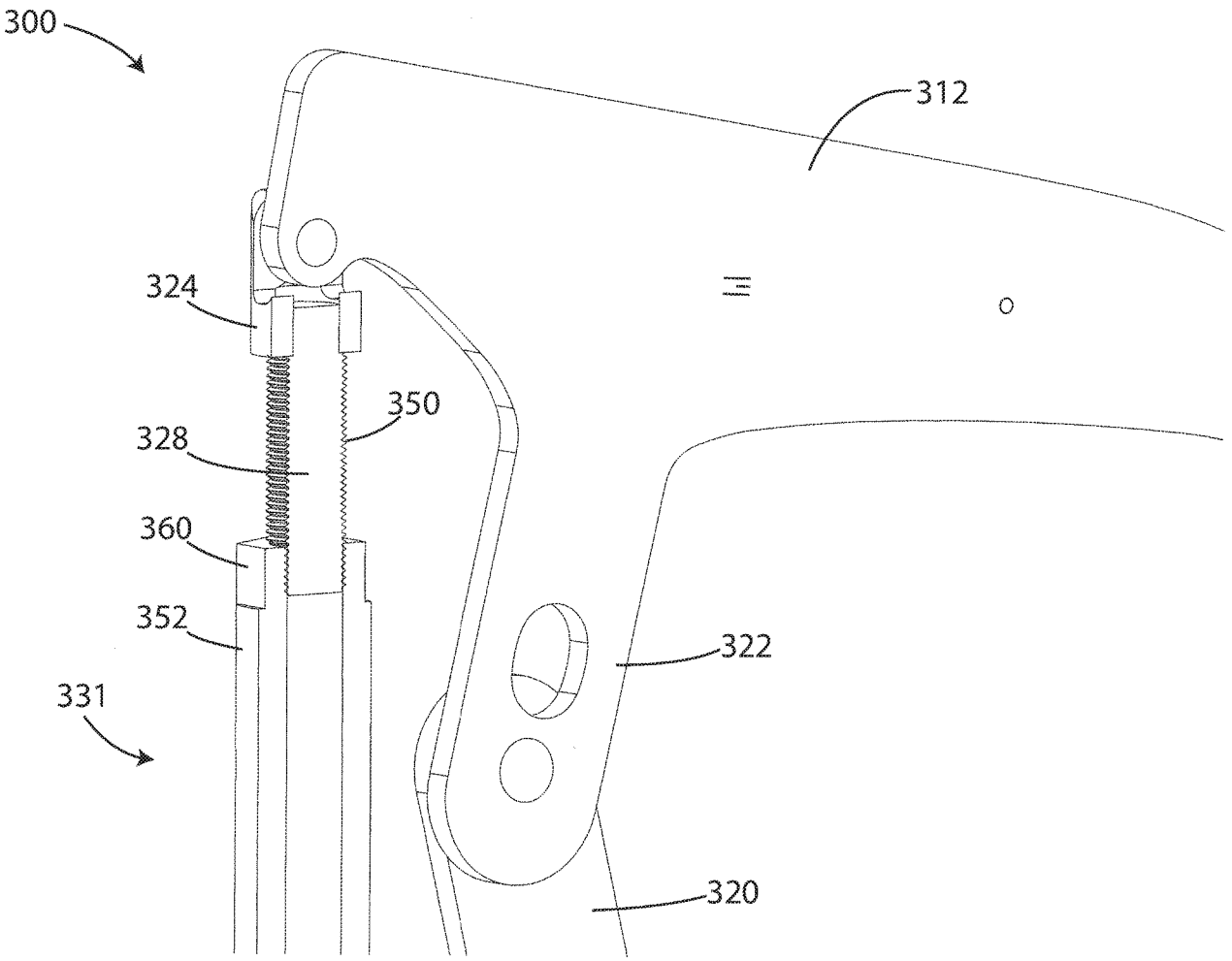
FIG. 13 depicts a cross sectional and enlarged view of a turnbuckle drive of the clamp of FIGS. 11 and 12 in accordance with one embodiment.
Figure 14:
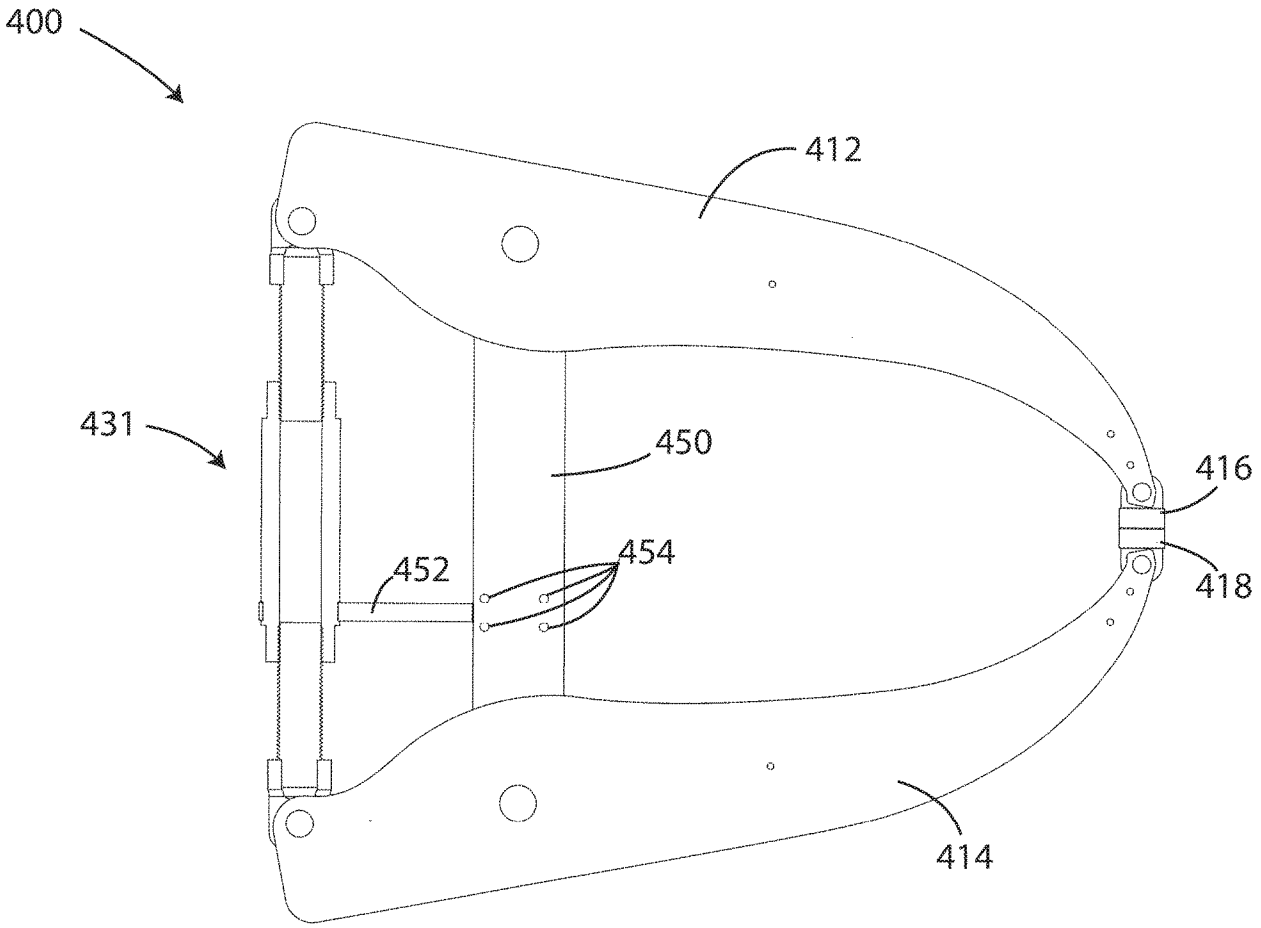
FIG. 14 depicts a side view of another clamp in accordance with one embodiment.
Figure 15:
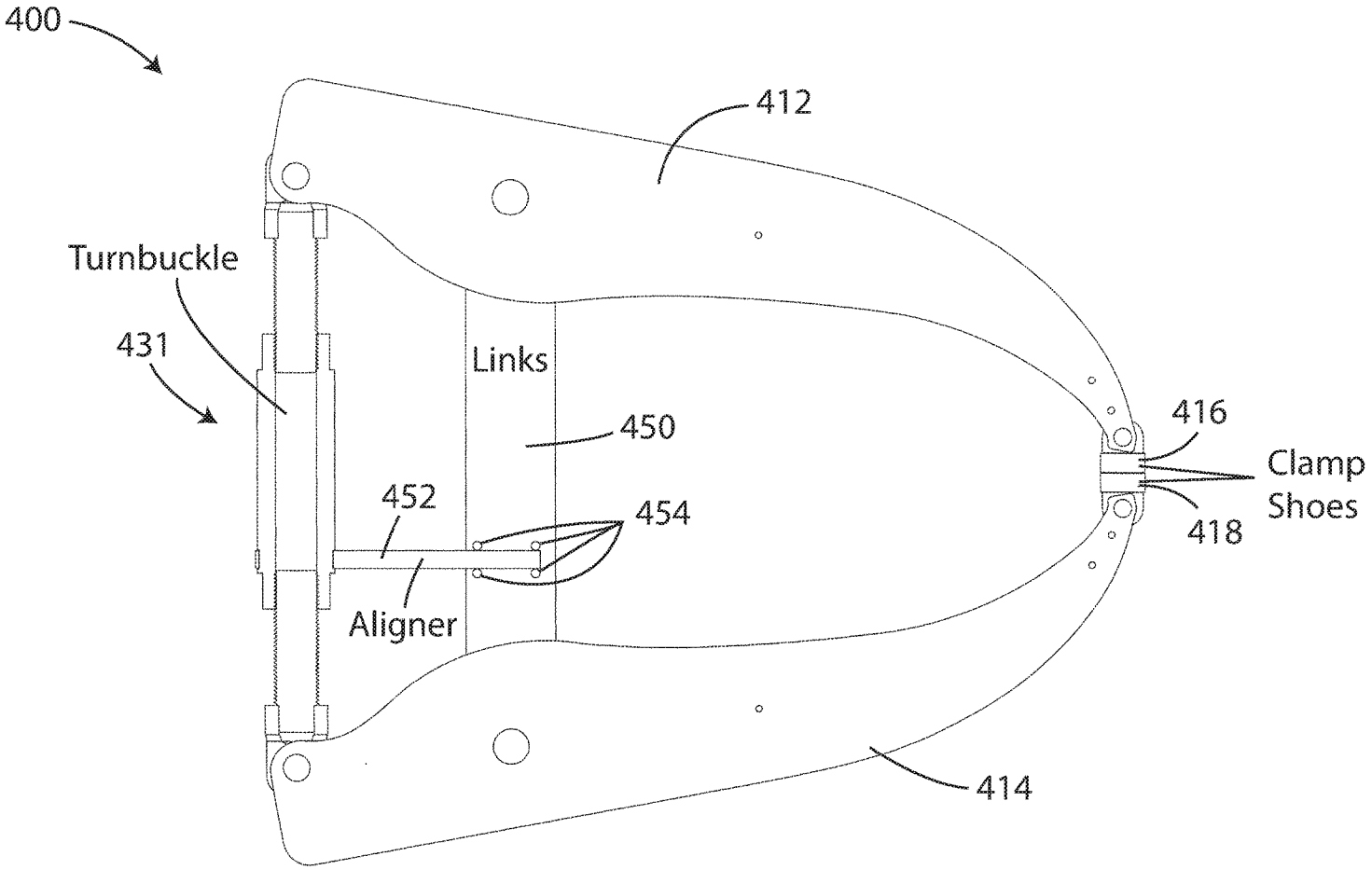
FIG. 15 depicts a side view of the clamp of FIG. 14 in accordance with one embodiment.
Figure 16:
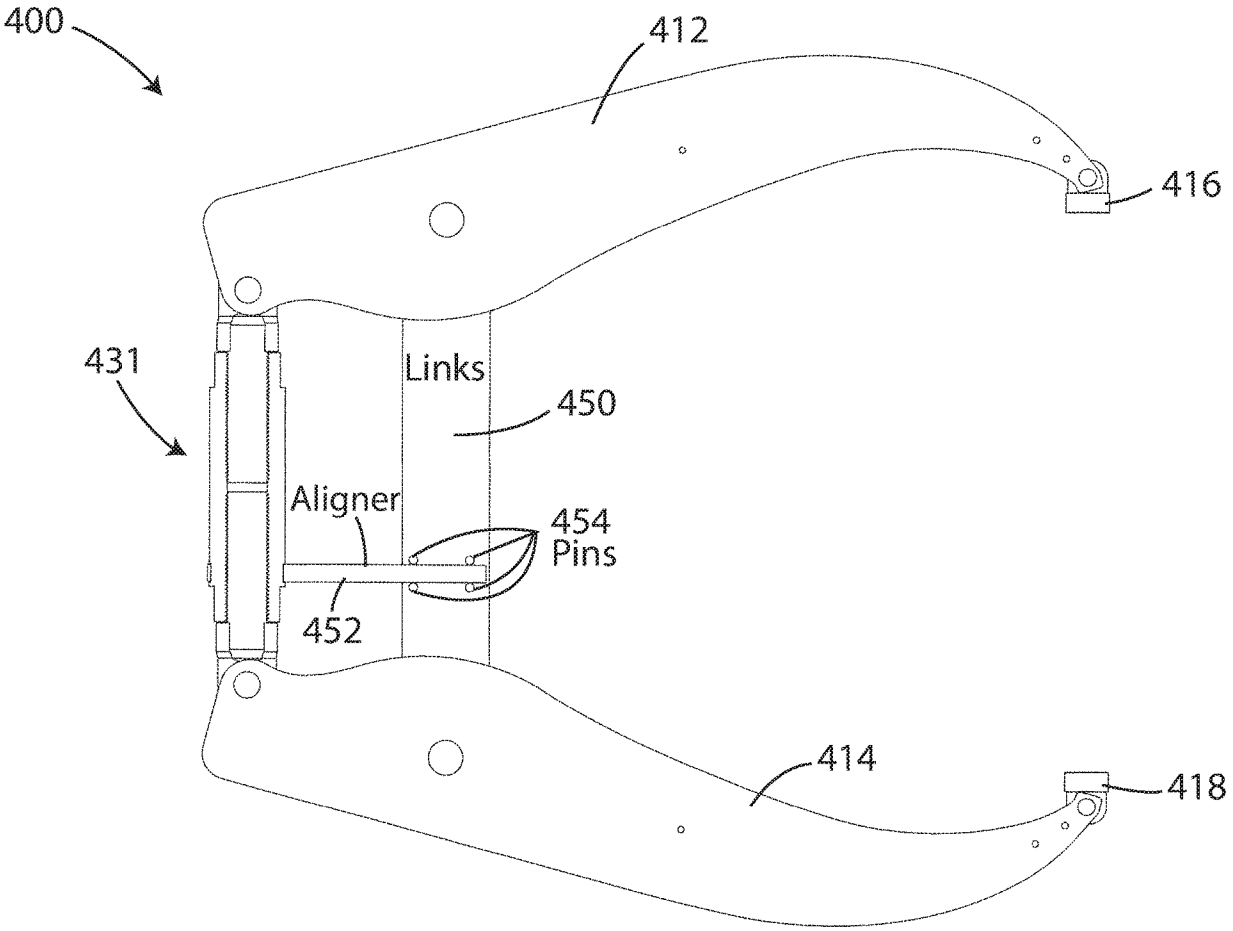
FIG. 16 depicts a side view of the clamp of FIGS. 14-15 in an open state in accordance with one embodiment.
Figure 17:
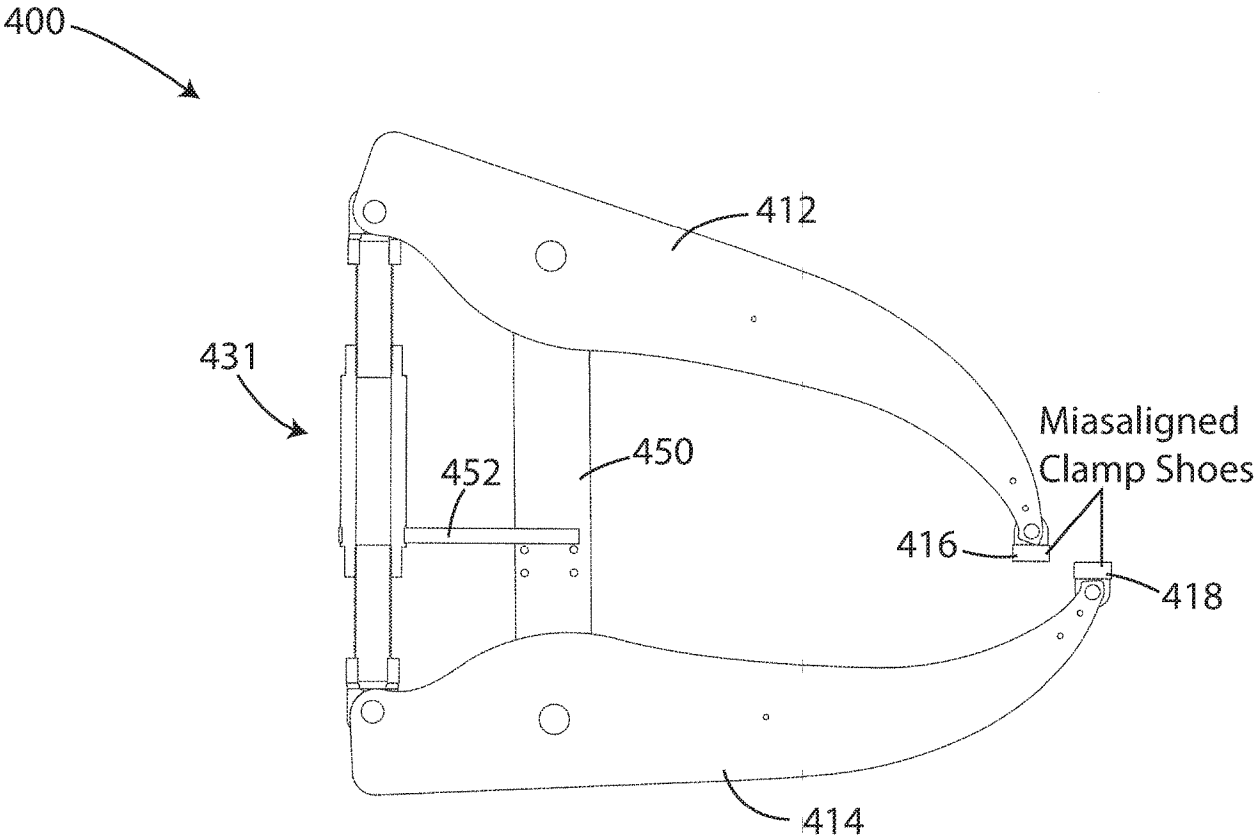
FIG. 17 depicts a side view of the clamp of FIGS. 14-16 in a misaligned state that would occur if the "aligner" was not working correctly in accordance with one embodiment.
Figure 18:
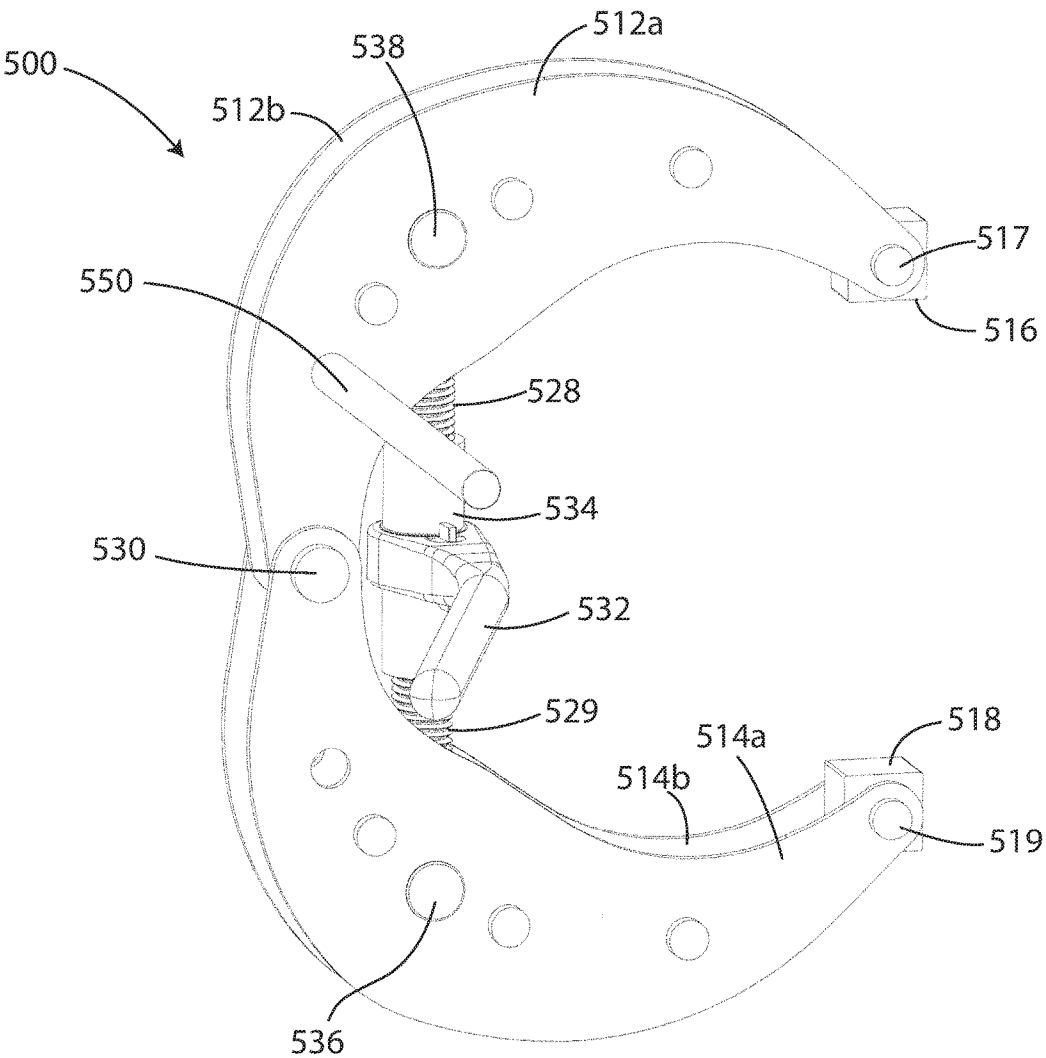
FIG. 18 depicts a front perspective view of another clamp in an open state in accordance with one embodiment.
Figure 19:
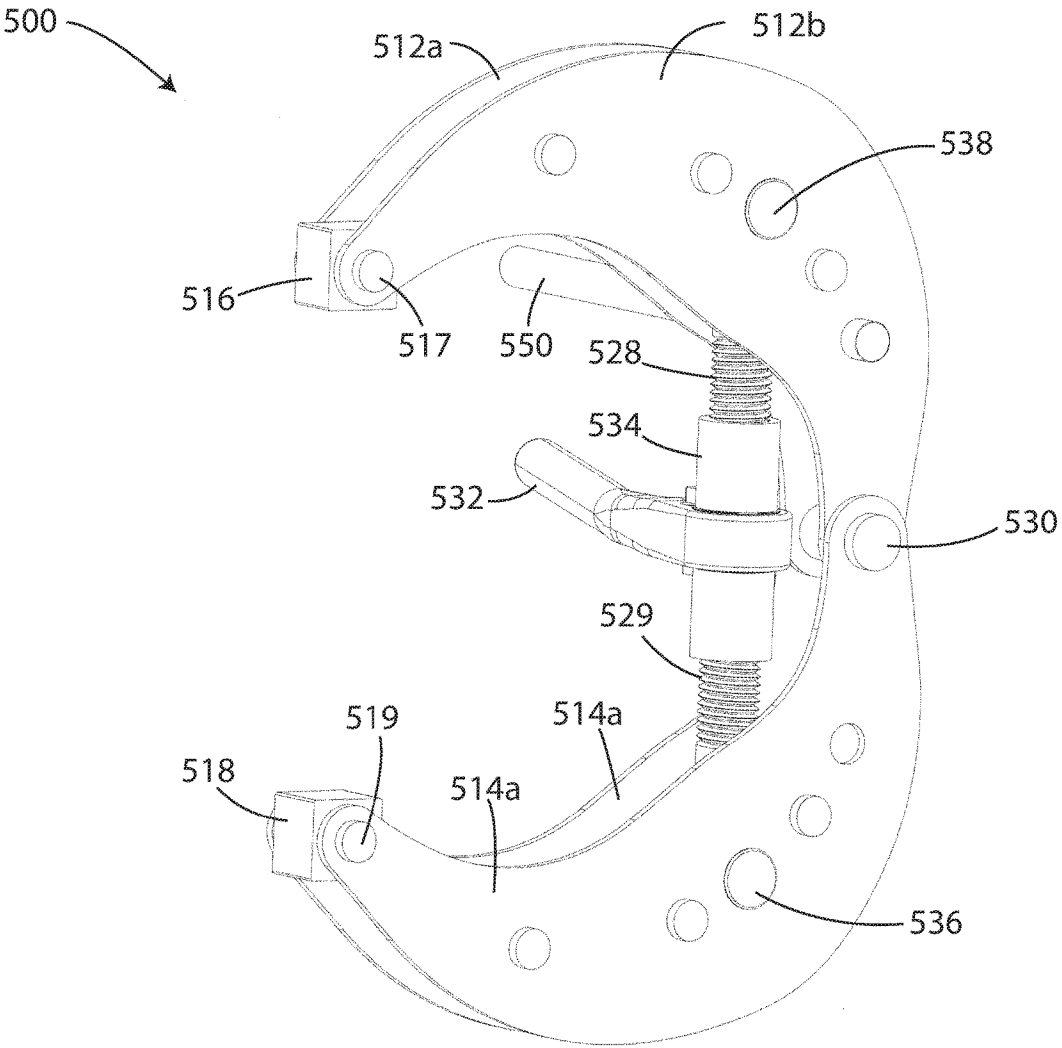
FIG. 19 depicts a back perspective view of the clamp of FIG. 18 in an open state in accordance with one embodiment.
Figure 20:
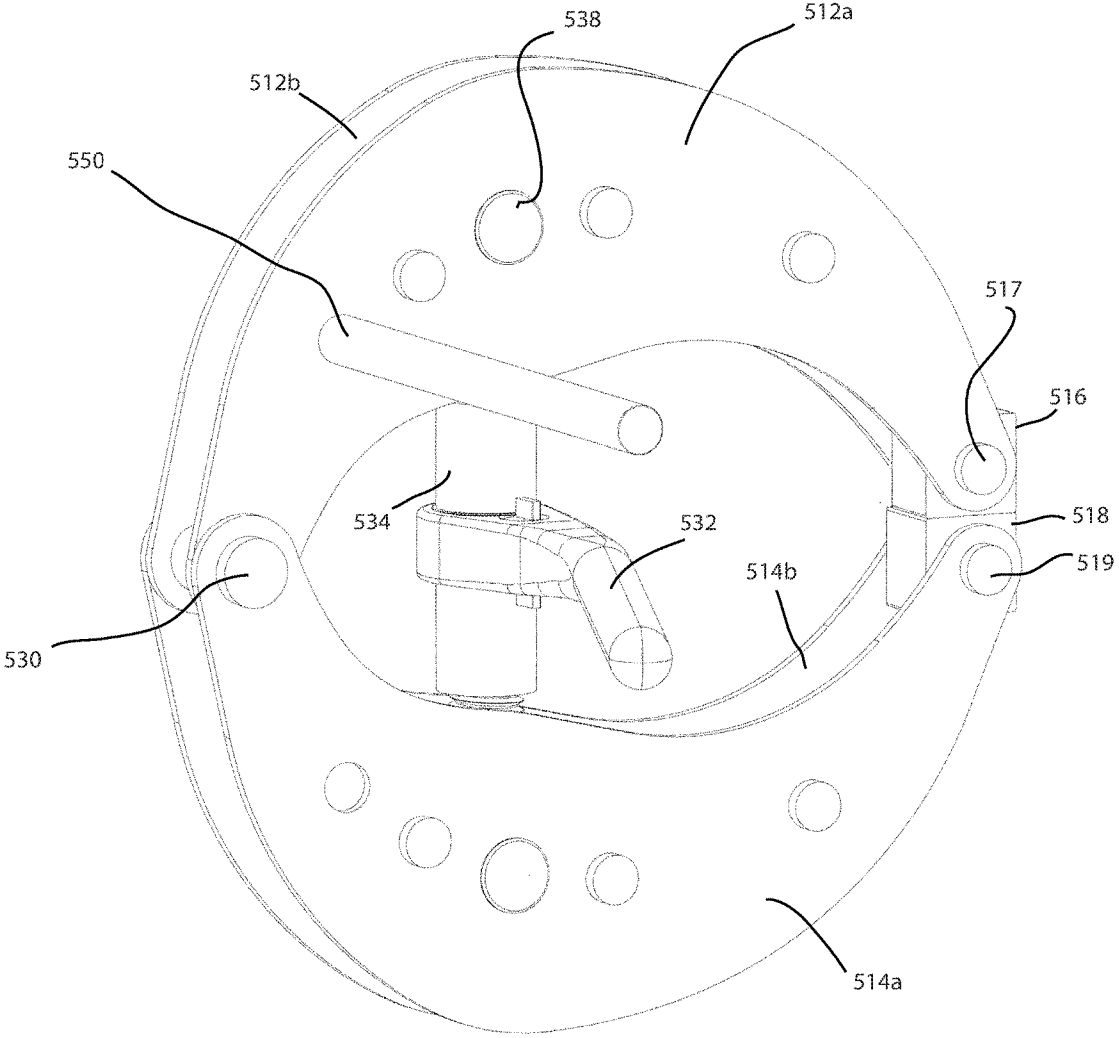
FIG. 20 depicts a front perspective view of the clamp of FIGS. 18-19 in a closed state in accordance with one embodiment.
Figure 21:
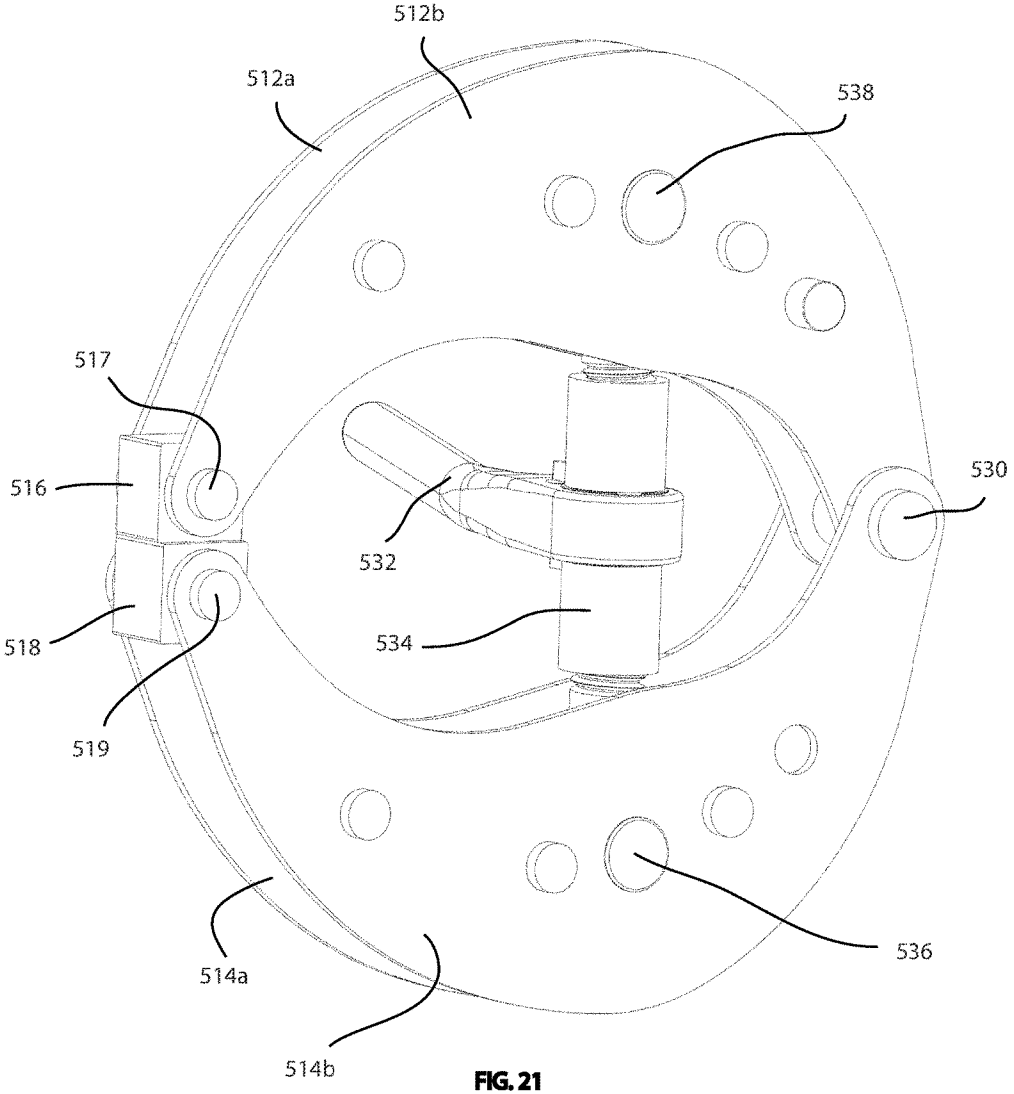
FIG. 21 depicts a back perspective view of the clamp of FIG. 18-20 in a closed state in accordance with one embodiment.
Figure 23:
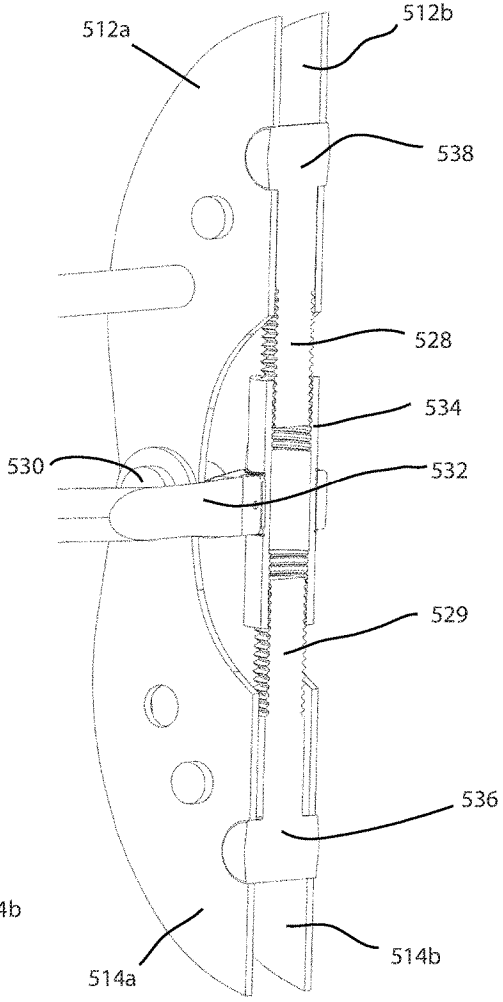
FIG. 23 depicts a cutaway perspective view of the clamp of FIGS. 18-22 in accordance with one embodiment.
Figure 22:
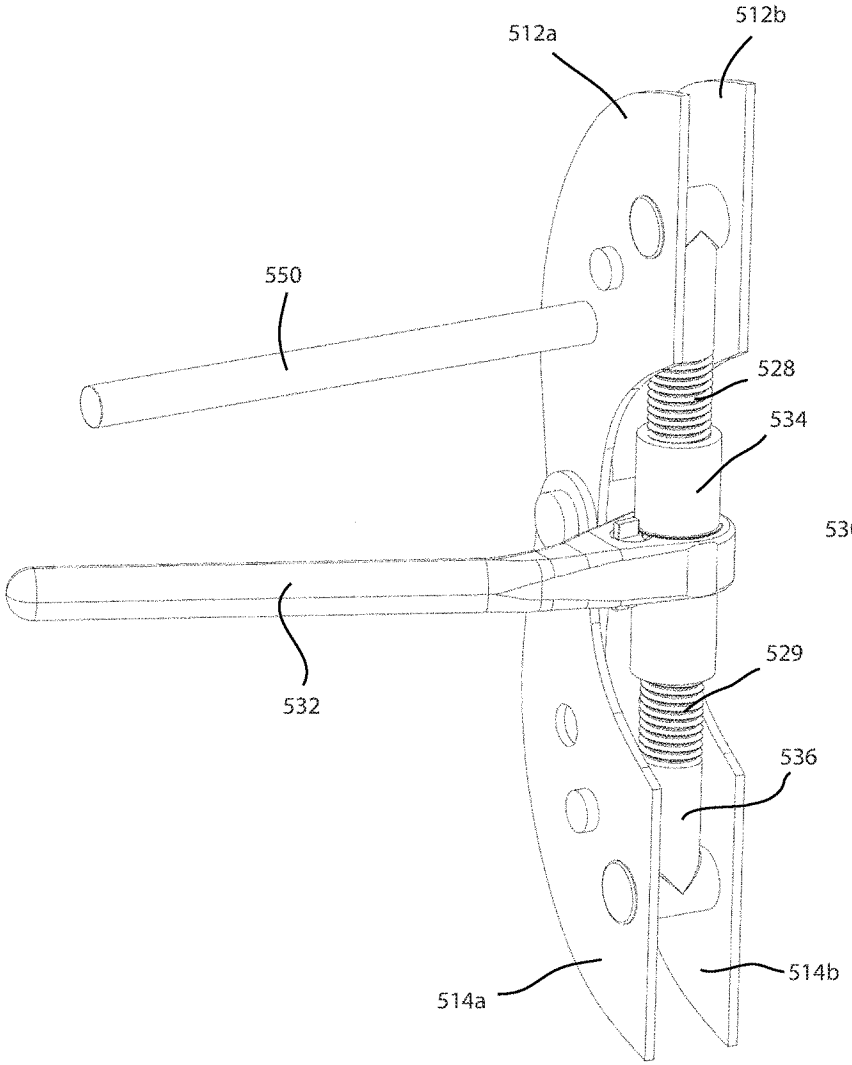
FIG. 22 depicts a cutaway perspective view of the clamp of FIGS. 18-21 in accordance with one embodiment.

Another clamp 300 is shown in FIGS. 11-13. This embodiment may be similar to the embodiment shown in FIGS. 8-9. Thus, the clamp 300 may include a first jaw 312 and a second jaw 314 (similar or the same as the jaws 112, 114), first and second clamping elements 316, 318 (similar or the same as the elements 116, 118), and lower extension plates 320 extending from the second jaw 314. The clamp 300 may include a turnbuckle drive 331 similar to the turnbuckle drive 131, including rotatable attachment elements 324, 326, and threaded elongated elements 328, 330. However, unlike the clamp 100, the clamp 300 may include a solid projection 322 projecting from the upper first jaw 312 to interact with the lower extension plate 320 to provide a pivot or fulcrum. Thus, the clamp 300 shows that one or both of these projections 320, 322 may be integrally fabricated as a portion of the jaws 312, 314. In other respects, the clamp 300 may be the same as or similar to the clamp 100.

Referring now specifically to FIG. 13, rapid opening and closing of the clamp 300 may be performed by running ones hand and forearm along the turnbuckle 331 to induce spinning. Rubber or other outer layer 352 may be provided on the turnbuckle 331 to promote the rapid spinning. Once the desired jaw opening is reached, a wrench may be used on one or more of the turnbuckle hexes 360 to fully tighten the clamp 300. Being in compression during tightening, several features shown in FIG. 13 have been included in the turnbuckle 331 design to reduce the risk of buckling and thread binding during tightening. A large diameter thread 350 has been chosen for improved buckling stability. The thread 350 locks into the yoke via a tight radial fit and a wide axial shoulder is provided. Both features may hold the screw in axial alignment under wench loads. It should be understood that the turnbuckles 131, 232, 331 and the turnbuckle 431 (described hereinbelow) may work in accordance with the above described principles.

Still another clamp 400 is shown in FIGS. 14-17. This embodiment may be similar to the embodiment shown in FIGS. 8-9 and 11-13. Thus, the clamp 400 may include a first jaw 412 and a second jaw 414 (similar or the same as the jaws 112, 114), first and second clamping elements 416, 418 (similar or the same as the elements 116, 118). The clamp 400 may include a turnbuckle drive 431 similar to the turnbuckle drive 131 and the turnbuckle drive 331, However, unlike the clamp 100 and the clamp 300, the clamp 400 may include a single link 450 extending between the upper arm 412 and the lower arm 414 at a midpoint along the upper arm 412 and the lower arm 414, the midpoint being closer to the turnbuckle drive 431 than the first and second clamping elements 416, 418. It should be understood that the link 450 may be two or more attached links in other embodiments. An aligner element 452 may extend from the turnbuckle drive 431 and the link or links 450. The aligner element 452 may be configured to rotate about the turnbuckle drive 431 so that the aligner element 452 does not rotate with respect to the jaws 412, 414 when the turnbuckle drive 431 does rotate with respect to the jaws 412, 414. The link 450 may include a plurality of pins 454 configured to retain the aligner element 452 in a stationary vertical location along the link 450 during movement of the turnbuckle drive 431. This may prevent the misalignment state that may otherwise occur, shown in FIG. 17.

Other embodiments are contemplated that are similar but may include different features than what is shown in the embodiments from FIGS. 1-17. For example, a clamp is contemplated having jaw profiles shown in the clamp 100 but having the turnbuckle 232 of the clamp 200. In this embodiment, the turnbuckle 131 may be removed and replaced with a solid non-expanding element.

Referring now to FIGS. 18-24, another embodiment of a clamp 500 is shown. The clamp 500 may include a similar large clamping reach as the embodiments described hereinabove, and may include a pair of upper jaws 512*a*, 512*b* and a pair of lower jaws 514*a*, 514*b* made of similar materials as the jaws described hereinabove. Further, the clamp 500 may include a hinge 530 located at a first end of each of the pairs of upper and lower jaws 512*a*, 512*b*, 514*a*, 514*b*. The clamp 500 may further include first and second clamping jaw members 516, 518 located at the second ends of each of the pairs of upper and lower jaws 512*a*, 512*b*, 514*a*, 514*b*.

Unlike the clamps described hereinabove, the clamps 512*a*, 512*b*, 514*a*, 514*b* may be parallel plates instead of singular components. The pairs of upper jaws 512*a*, 512*b* may be thin to create an open space there between which may provide room for the turnbuckle drive 534. For example, the upper jaws 512*a*, 512*b* may be parallel plates. Similarly, the lower jaws 514*a*, 514*b* may be parallel plates. Further unlike the previous clamps, the first and second clamping jaw members 516, 518 may be held between the jaw plates 512*a* and 512*b*, and the jaw plates 514*a* and 514*b*. The first and second clamping jaw members 516, 518 may be held between the jaw plates 512, 514 by hinge members 517, 519. The hinge members 517, 519 may be cylindrical elements extending between the jaw plates 512, 514 and through the clamping jaw members 516, 518 at the second end.

Further, the clamp 500 may include a turnbuckle drive 534 extending between the pairs of upper and lower jaws 512*a*, 512*b*, 514*a*, 514*b* at a mid-point along the pairs of upper and lower jaws 512*a*, 512*b*, 514*a*, 514*b* proximate the end with the hinge 530. The turnbuckle drive 534 may be quickly turned in order to expand the threaded elongated elements 528, 529 which are attached to the top and bottom jaw plates 512*a*, 512*b*, 514*a*, 514*b*, respectively, using T-bolts 536, 538, respectively. The T-bolts 536, 538 may be configured to rotate with respect to the pairs of upper and lower jaws 512*a*, 512*b*, 514*a*, 514*b* to allow for opening and closing of the pairs of upper and lower jaws 512*a*, 512*b*, 514*a*, 514*b*. The turnbuckle drive 534 may be configured to expand and contract the threaded elongated elements 528, 529. In the clamp 500, the turnbuckle drive 534 may be a tension curing load application.

Figure 24:
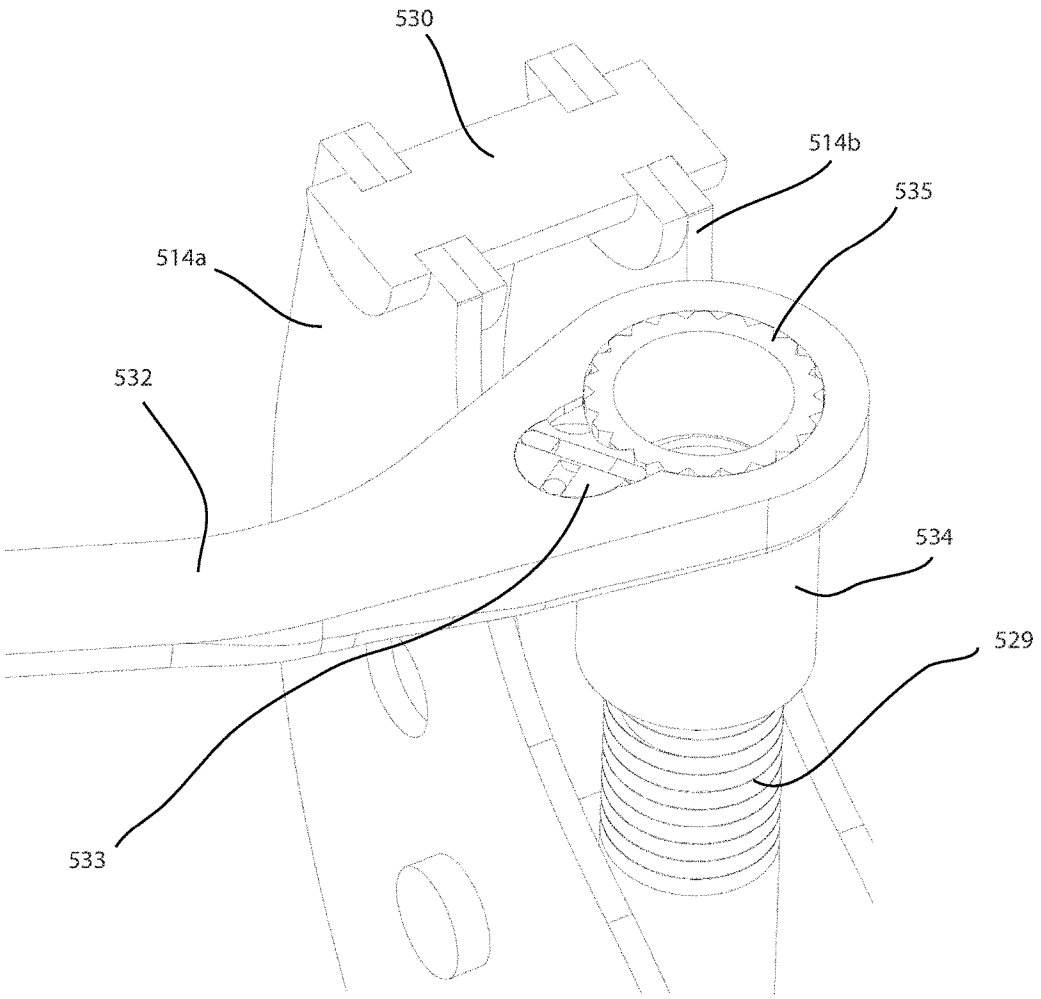
FIG. 24 depicts a cutaway perspective view of the clamp of FIGS. 18-23 in accordance with another embodiment.

The turnbuckle drive 534 may be driven with a permanently attached two way ratchet 532. An operator may use a leverage extending handle 550 for leverage against the clamp 500 to facilitate rotating the turnbuckle drive 534 with the ratchet 532. As shown in FIG. 24, the ratchet 532 may be two way, and may include a switch 533 which may be rotated to provide for ratcheting in both directions to both expand and contract the clamp 500. Within the ratchet 532 may be a gear 535 that provides for interaction with the switch 533 and the ratchet 532. Thus, the turnbuckle drive 534 may provide for easy and quick opening and closing of the clamp 500 and may provide sufficient leverage for extremely high pressure clamping. Further, the ratchet 532 may be detachable in embodiments where the clamp 500 may be operable in tight spaces.

Referring now to FIGS. 25-32, another embodiment of a clamping apparatus 600 is shown. The clamping apparatus 600 may include a similar large clamping reach as the embodiments described hereinabove. The clamp 600 may include an upper jaw structure 602 and a lower jaw structure 604. The upper jaw structure 602 may include a first upper jaw 612*a* and a second upper jaw 612*b*. The lower jaw structure 604 may include a first lower jaw 614*a* and a second lower jaw 614*b*. The first and second upper jaws 612*a*, 612*b* may be parallel plates having a generally C-shaped profile. The first and second lower jaws 612*a*, 612*b* may be parallel plates having a generally C-shaped profile. In other embodiments, the upper and lower jaw structures 602, 604 may each include only a single structural component or frame. Like the clamps described hereinabove, the upper and lower jaws 612*a*, 612*b*, 614*a*, 614*b* may be made of a stiff material that is resistant to permanent deformation in order to provide for large clamping reach with simultaneously high clamping loads. For example, materials such as High Strength Low Alloy Steel or other like materials may be utilized. Other metals and steels are also contemplated.

The upper jaw structure 602 may include a hinge end 605 and a clamp end 607. Each of the first and second upper jaws 612*a*, 612*b* may include a hinge end 606*a*, 606*b* and a clamp end 607*a*, 607*b*, respectively. The lower jaw structure 604 may include a hinge end 608 and a clamp end 609. Each of the first and second lower jaws 614*a*, 614*b* may also include a hinge end 608*a*, 608*b* and a clamp end 609*a*, 609*b*, respectively. The thickness of the upper jaws 612*a*, 612*b* and the lower jaws 614*a*, 614*b* may vary depending on the embodiment and the loading required of the clamp 600.

The profile of the upper jaws 612*a*, 612*b* may be C-shaped and may widen in a middle 610 location. The upper jaws 612*a*, 612*b* may each include an outer edge 650*a*, 650*b* and an inner edge 651*a*, 651*b*. The inner edges 651*a*, 651*b* may each include a curve or bend 654*b*, 655*b*, respectively, at the middle 610 that includes a center of curvature (not shown) located farther from the first and second lower jaws 614*a*, 614*b* than the inner edges 651*a*, 651*b*. The inner edges 651*a*, 651*b* may each be curved having a first bend 654*a*, 655*a*, a second bend 654*b*, 655*b*, and a third bend 654*c*, 655*c*. The first bends 654*a*, 655*a*, the second bends 654*b*, 655*b*, and the third bends 654*c*, 655*c* may create a wave shaped profile along the inner edges 651*a*, 651*b*. The second bends 654*b*, 655*b* may be each curved in a different direction than the first bends 654*a*, 655*a*, and the third bends 654*c*, 655*c*. This particular profile may be configured to add strength to the upper jaws 612*a*, 612*b* to prevent buckling under high clamping forces or pressures.

The profile of the lower jaws 614*a*, 614*b* may also be C-shaped and may widen in a middle 611 location. The lower jaws 614*a*, 614*b* may each include an outer edge 652*a*, 652*b* and an inner edge 653*a*, 653*b*. The inner edges 653*a*, 653*b* may each include a curve or bend 656*b*, 657*b*, respectively, at the middle 611 that includes a center of curvature (not shown) located farther from the first and second upper jaws 612*a*, 612*b* than the inner edges 653*a*, 653*b*. The inner edges 653*a*, 653*b* may each be curved having a first bend 656*a*, 657*a*, a second bend 656*b*, 657*b*, and a third bend 656*c*, 657*c*. The first bends 656*a*, 657*a*, the second bends 656*b*, 657*b*, and the third bends 656*c*, 657*c* may create a wave shaped profile along the inner edges 653*a*, 653*b*. The second bends 656*b*, 657*b* may be each curved in a different direction than the first bends 656*a*, 657*a*, and the third bends 656*c*, 657*c*. This particular profile may be configured to add strength to the lower jaws 614*a*, 614*b* to prevent buckling under high clamping forces or pressures.

The first and second upper jaws 612*a*, 612*b* and the first and second lower jaws 614*a*, 614*b* may be hingedly attached at a hinge 630. The hinge 630 may be located at the hinge ends 605, 608 of the upper and lower jaw structures 602, 604. The hinge 630 may be located at the hinge ends 606*a*, 606*b* of the first and second upper jaws 612*a*, 612*b* and at the hinge ends 608*a*, 608*b* of the first and second lower jaws 614*a*, 614*b*. The hinge 630 may be a cylindrical pin that provides for rotation of the upper jaw structure 602 with respect to the lower jaw structure 604.

Figure 26:
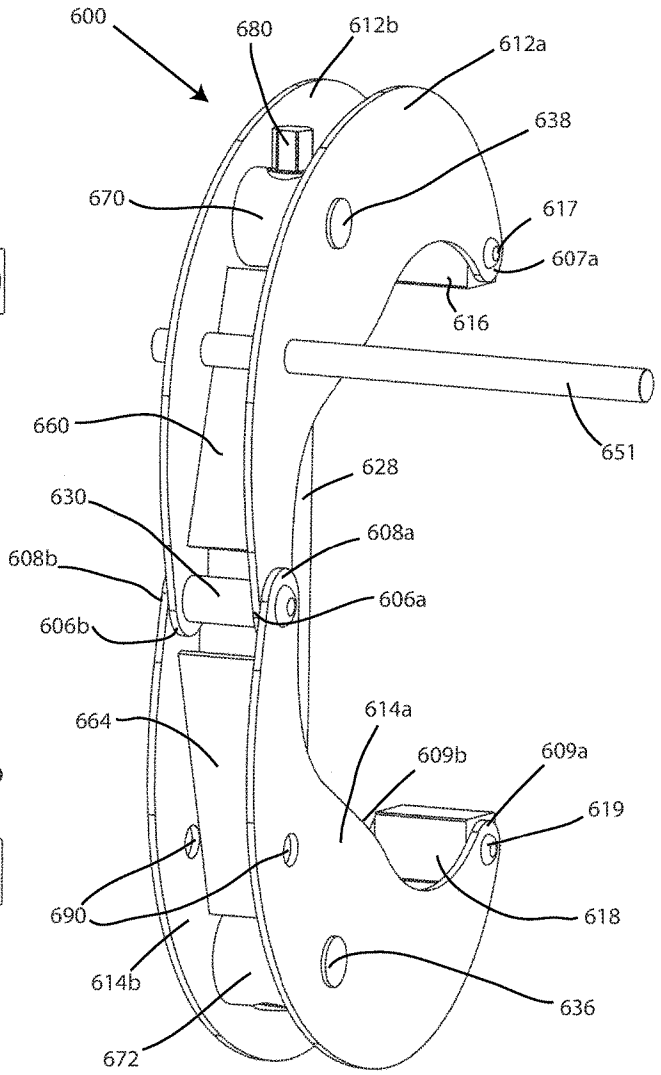
FIG. 26 depicts a perspective view of the clamp of FIG. 25 in the open state in accordance with one embodiment.
Figure 25:
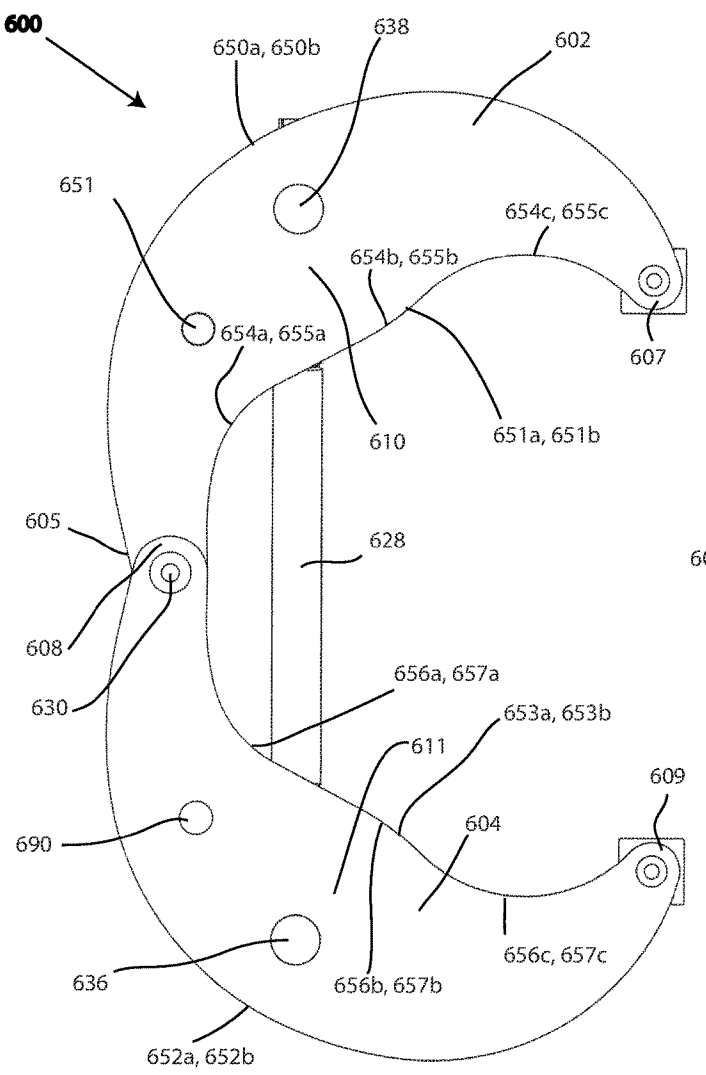
FIG. 25 depicts a side view of another clamp in an open state in accordance with one embodiment.
Figure 27:
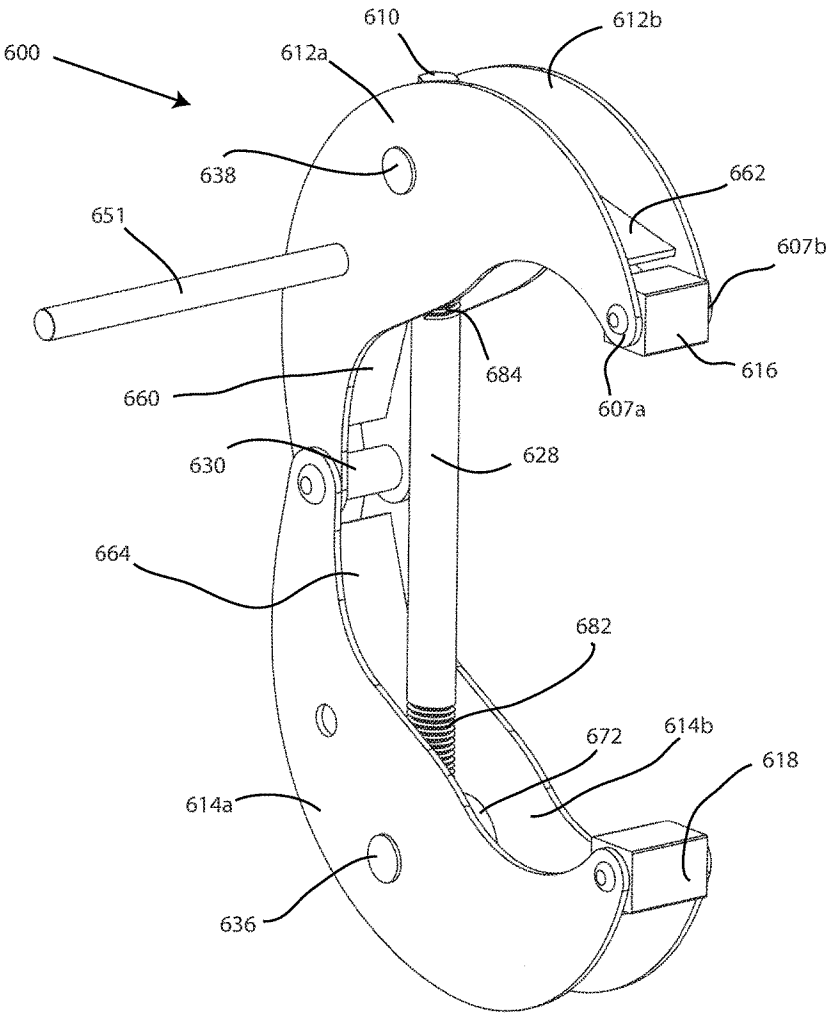
FIG. 27 depicts a perspective view of the clamp of FIGS. 25-26 in the open state in accordance with one embodiment.
Figure 28:
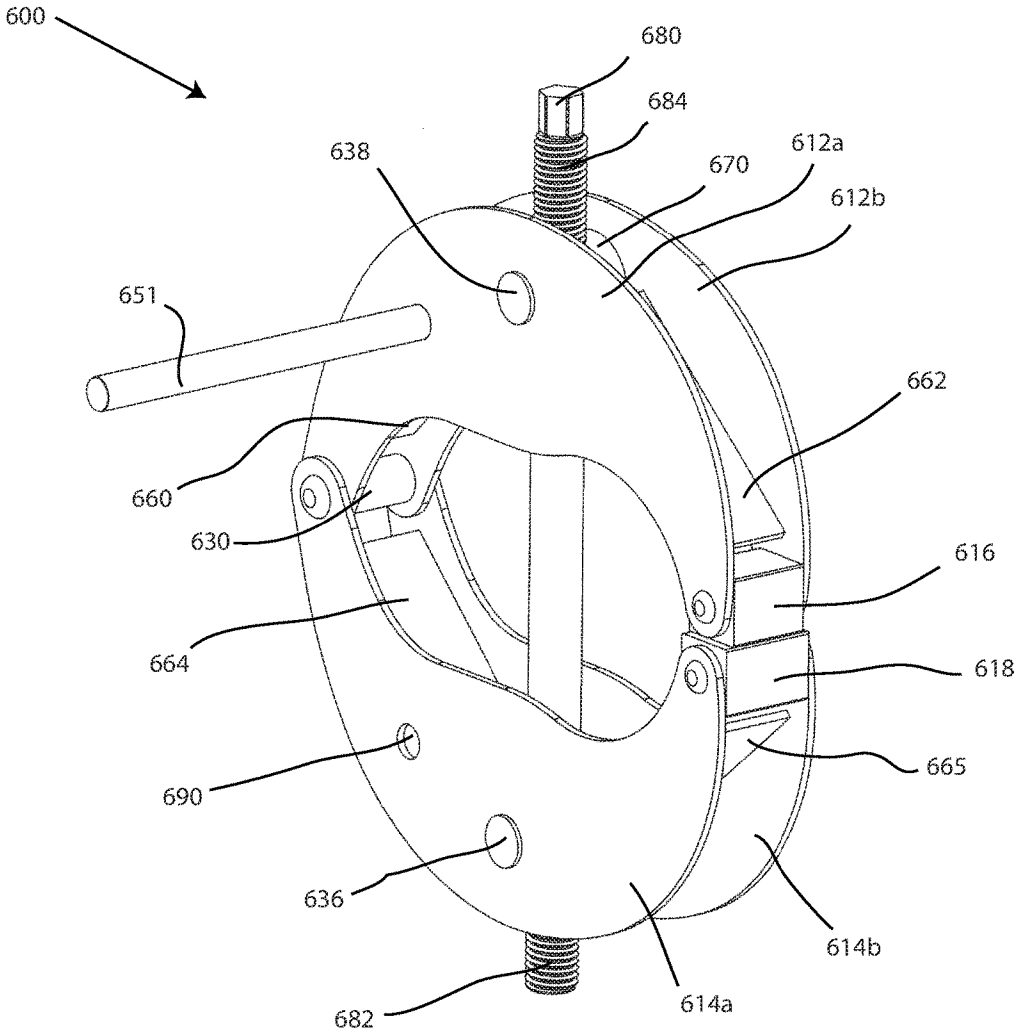
FIG. 28 depicts a perspective view of the clamp of FIGS. 25-27 in a closed state in accordance with one embodiment.

The clamping apparatus 600 may further include an elongated element 628 threadably attached to the upper jaw structure 602 between the hinge end 605 and the clamp end 607. In particular, the elongated element 628 may be located between the first and second upper jaws 612*a*, 612*b*. The elongated element 628 may further be located between the first and second lower jaws 614*a*, 614*b*. The elongated element 628 may extend between the upper jaw structure 602 to the lower jaw structure 604. The elongated element 628 may be attached to the upper jaw structure 602 at or close to the middle 610 of the upper jaw structure 602. The elongated element 628 may be attached to the lower jaw structure 604 at or close to the middle 611 of the lower jaw structure 604. The elongated element 628 may include a circular cross section with a lower threaded end 682 and an upper threaded end 684. The elongated element 628 may be made from a metallic material that is resistant of deformation at the loading capacity of the clamping apparatus 600. The threads of the threaded ends 682, 684 may also be strong enough to resist stripping when the elongated element 628 is rotated under high clamping loads. The elongated element 628 may extend above the upper jaw structure 602 and the lower jaw structure 604 when the clamp ends 607, 609 are closed together, as shown in FIGS. 28-32. When the clamp ends 607, 609 are separated, the elongated element 628 may not extend from the upper jaw structure 602 and the lower jaw structure 604, as shown in FIGS. 25-27.

Rotation of the elongated element 628 in a first direction R1 (shown in FIG. 32) may cause the clamp end 607 of the upper jaw structure 602 to move closer to the clamp end 609 of the lower jaw structure 604. Rotation of the elongated element 628 in a second direction R2 that is opposite to the first direction R1 may cause the clamp end 607 of the upper jaw structure 602 to separate from the clamp end 609 of the lower jaw structure 604. The elongated element may further include an end 680 configured to receive a tool 699. The end 680 may have, for example, a hexagonal cross section. The tool 699 may be, for example, a hand wrench, as shown. In other embodiments, the tool 699 may be an impact wrench, a ratchet or the like. The tool 699 may be configured to facilitate rotation of the elongated element 628 with respect to the clamp apparatus 600 and the upper and lower jaw structures 602, 604.

Figure 30:
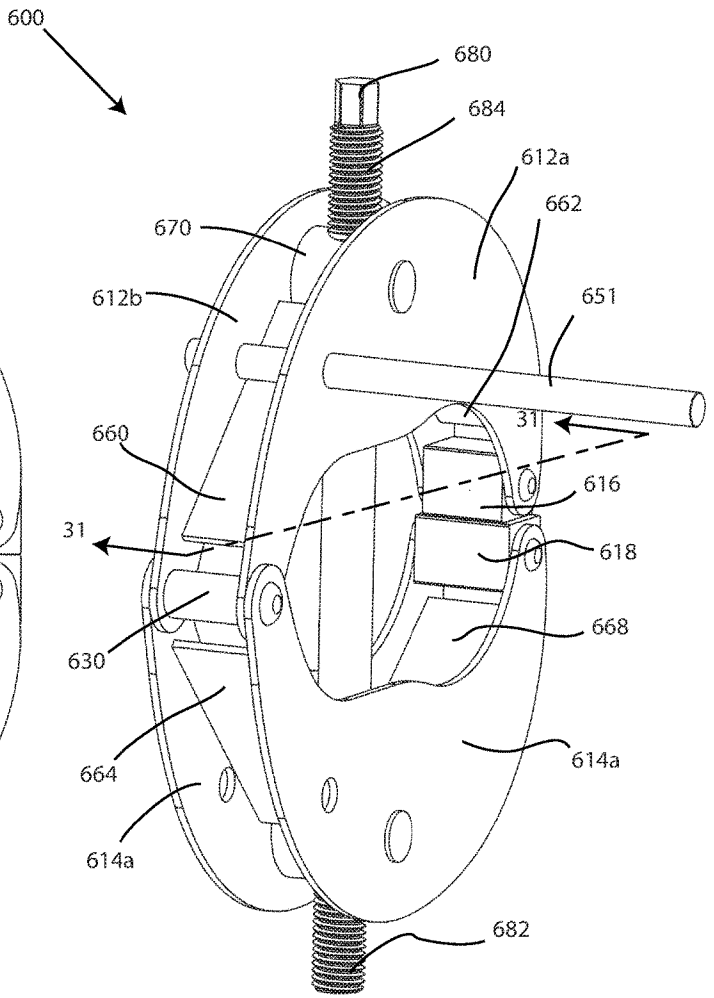
FIG. 30 depicts a perspective view of the clamp of FIGS. 25-29 in the closed state in accordance with one embodiment.
Figure 29:
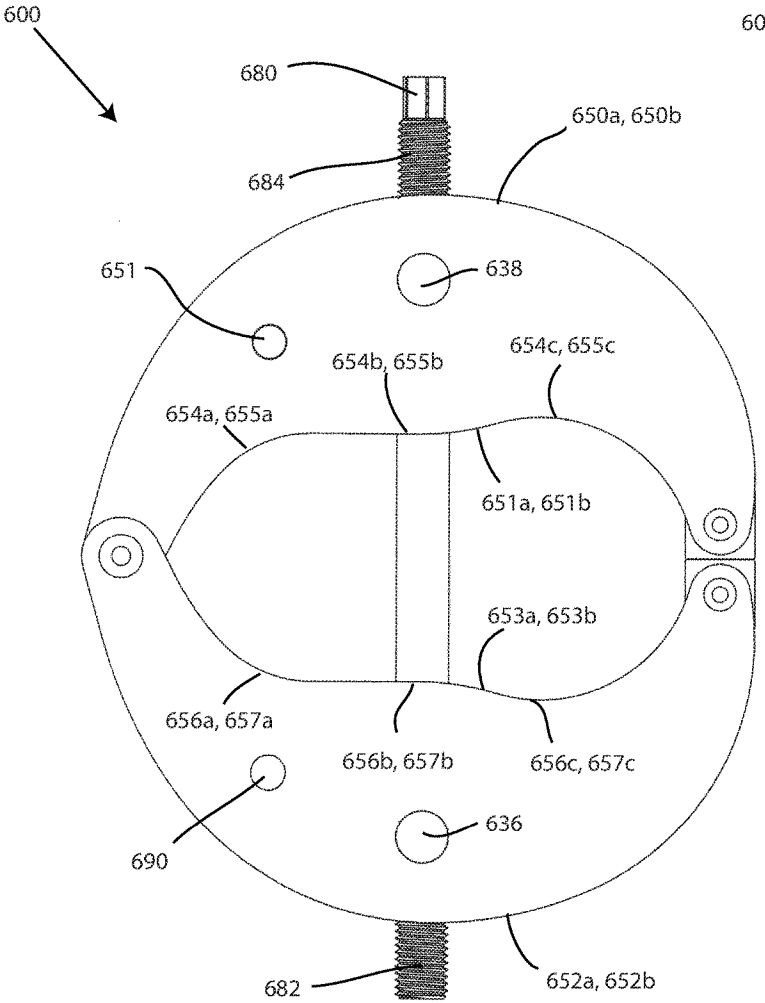
FIG. 29 depicts a side view of the clamp of FIGS. 25-28 in the closed state in accordance with one embodiment.
Figure 31:
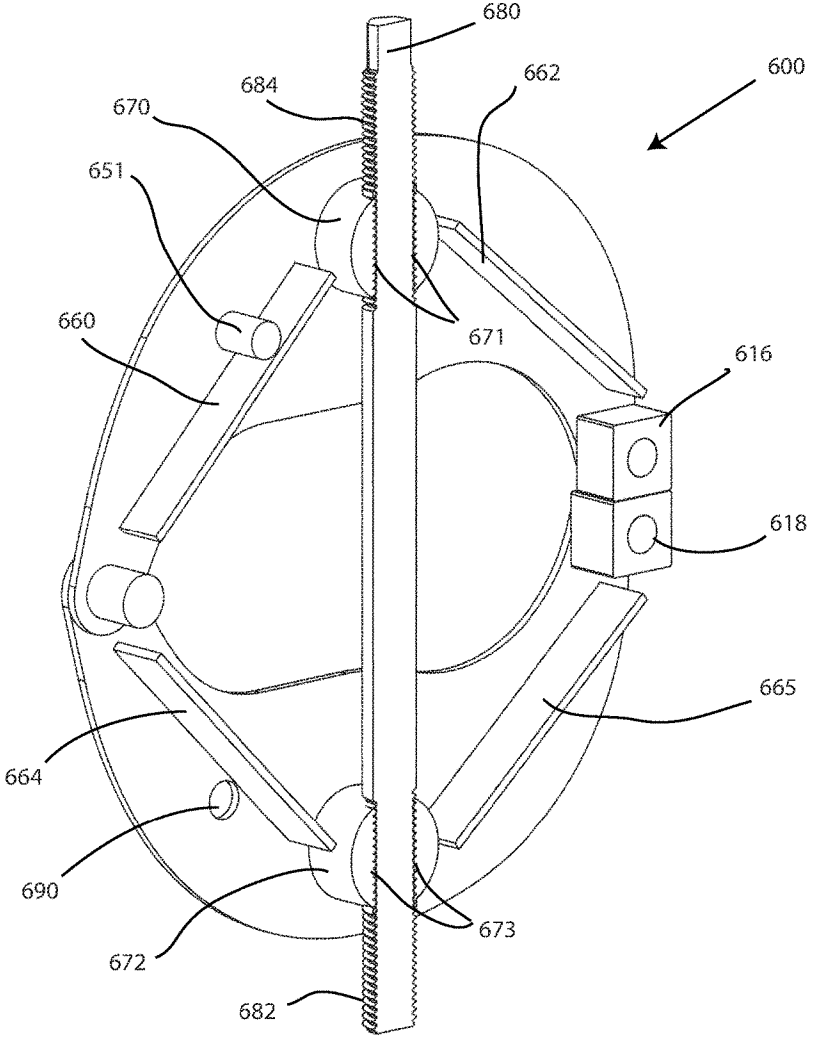
FIG. 31 depicts a cutaway view of the clamp of FIGS. 25-30, taken at arrows 31-31 in accordance with one embodiment.
Figure 32:
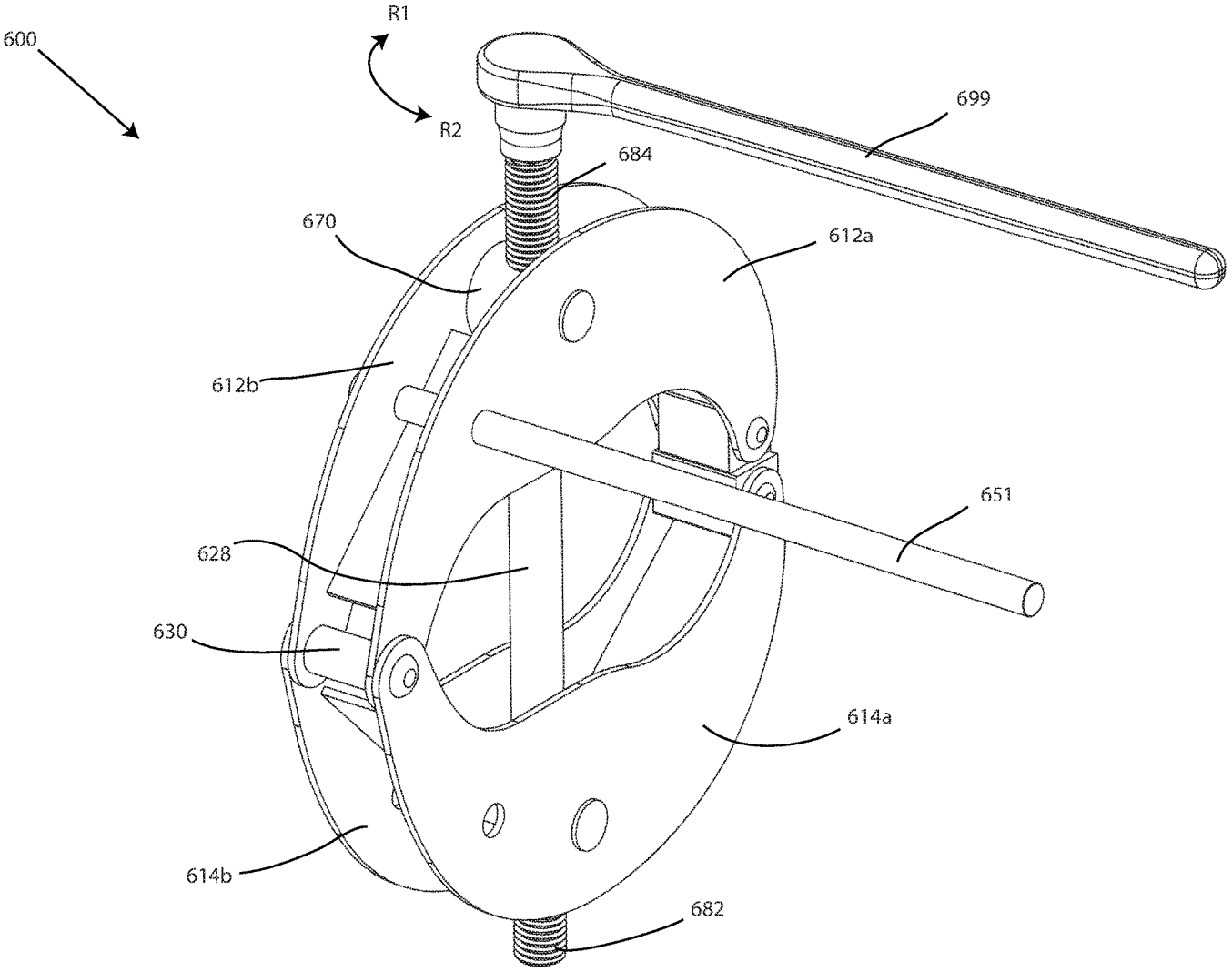
FIG. 32 depicts a perspective view of the clamp of FIGS. 25-31 operated by a ratchet in accordance with one embodiment.
Figure 33:
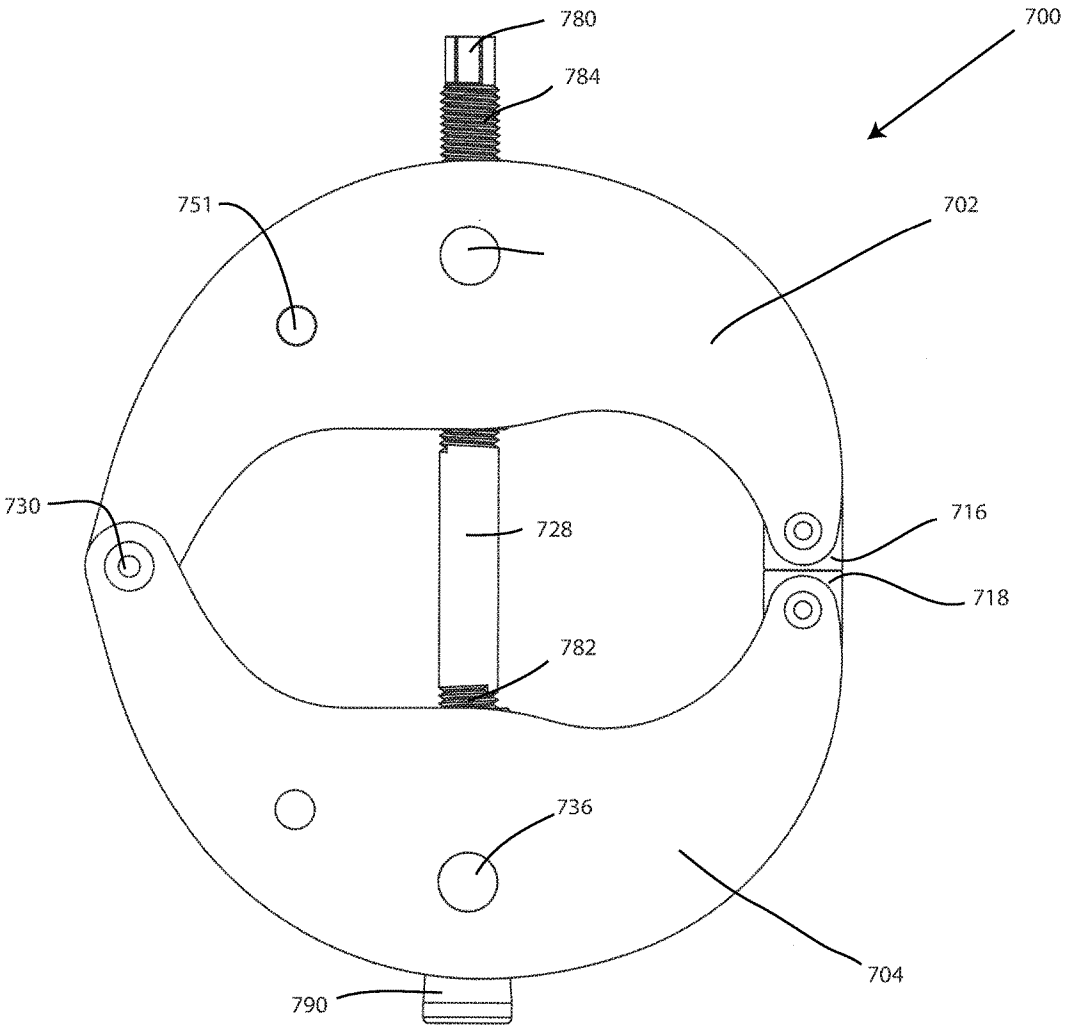
FIG. 33 depicts a side view of a clamp having a safety stop in accordance with one embodiment.
Figure 34:
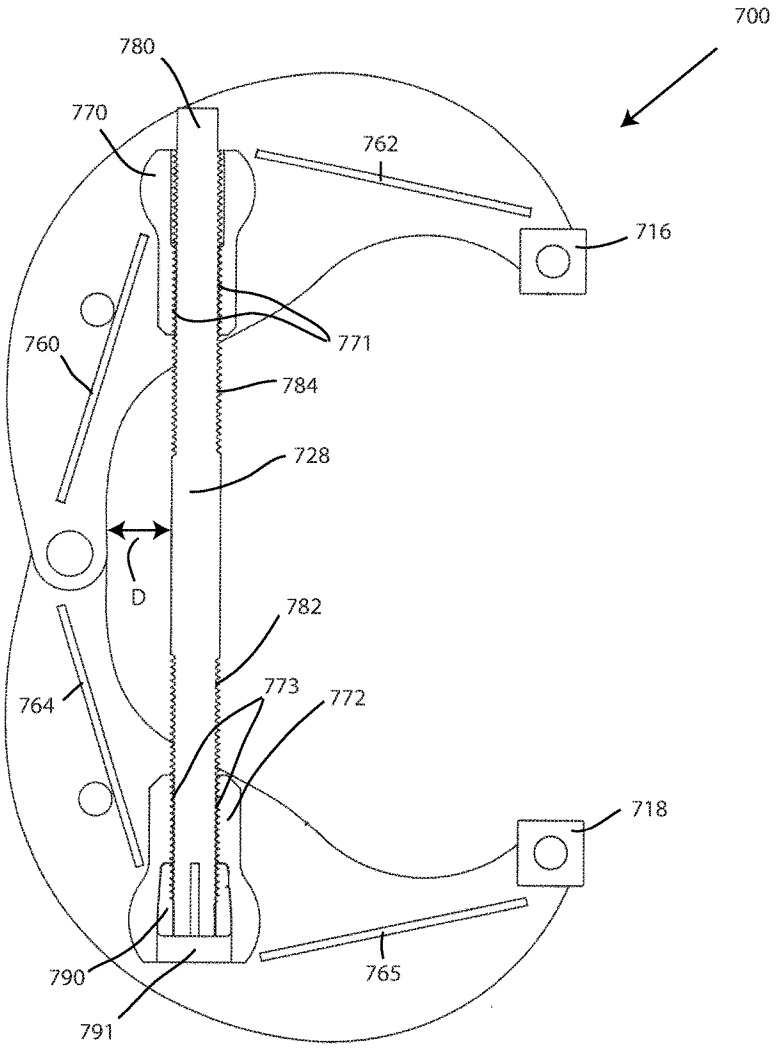
FIG. 34 depicts a cutaway view of the clamp of FIG. 33 in an open state in accordance with one embodiment.
Figure 35:
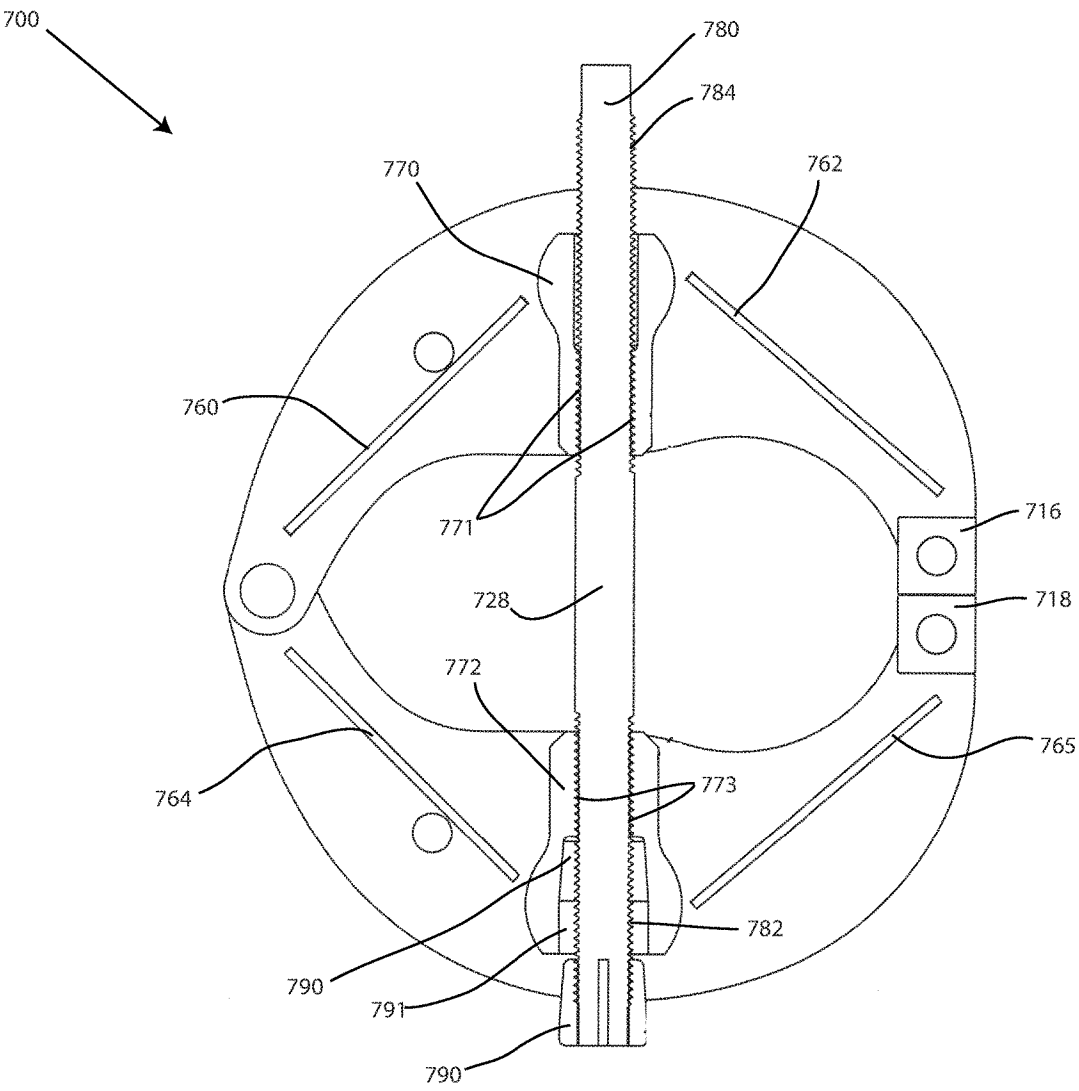
FIG. 35 depicts a cutaway view of the clamp of FIGS. 33-34 in a closed state in accordance with one embodiment.
Figure 36:
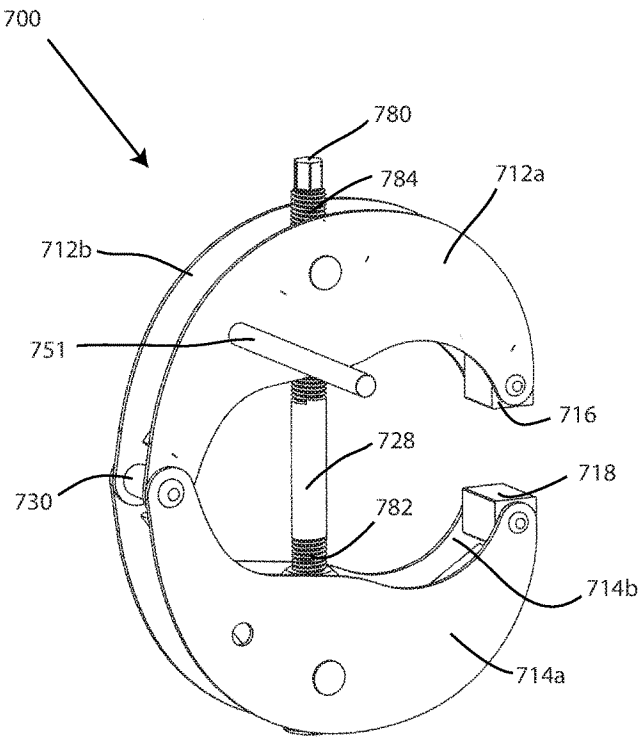
FIG. 36 depicts a perspective view of the clamp of FIGS. 33-35 in a partially open state in accordance with one embodiment.

Referring to FIG. 31, a cross sectional view of the clamping apparatus 600 is shown taken at arrows 31-31 from FIG. 30. The cross section view is taken at plane that extends midway between the first and second upper jaws 612*a*, 612*b* and the first and second lower jaws 614*a*, 614*b*. Holding the elongated element 628 between the first and second upper jaws 612*a*, 612*b* and the first and second lower jaws 614*a*, 614*b* are a top circular nut 670 and a bottom circular nut 672. The top circular nut 670 and the bottom circular nut 672 may each be metallic components.

The top circular nut 670 may have a circular cross section that extends between the first and second upper jaws 612*a*, 612*b*. The top circular nut 670 may be attached to each of the first and second upper jaws 612*b*, 612*b* with bosses 638. The bosses 638 may be integral to the top circular nut 670. The bosses 638 may also be bolts, bars, pins, rods, screws, or the like. The top circular nut 670 may include a vertically disposed threaded opening 671 extending through the entirety of the top circular nut 670 configured to receive the upper threaded end 684 of the elongated element 628. The threaded opening 671 may include non-binding threads which are configured to integrate with the metallic material of the elongated element 628 to allow for non-binding rotation.

The bottom circular nut 672 may be similar or the same in structure to the top circular nut 670 in one embodiment. The bottom circular nut 672 may have a circular cross section that extends between the first and second lower jaws 614*a*, 614*b*. The bottom circular nut 672 may be attached to each of the first and second lower jaws 614*b*, 614*b* with bosses 636. The bottom circular nut 672 may include a vertically disposed threaded opening 673 extending through the entirety of the bottom circular nut 672 configured to receive the bottom threaded end 682 of the elongated element 628. The threaded opening 673 may include non-binding threads which are configured to integrate with the metallic material of the elongated element 628 to allow for non-binding rotation.

The first upper jaw 612*a* may be fixedly coupled to the second upper jaw 612*b* such that the first upper jaw 612*a* is spaced apart from the second upper jaw 612*b*. Likewise, the first lower jaw 614*a* may be fixedly coupled to the second lower jaw 614*b* such that the first lower jaw 614*a* is spaced apart from the first lower jaw 614*b*. This spacing may correspond to the width of the hinge 630, long with the spacing of a first upper internal plate 660, a second upper internal plate 662, a first lower internal plate 664 and a second lower internal plate 665.

Located between the first upper jaw 612*a* and the second upper jaw 612*b* may be the first upper internal plate 660 and the second upper internal plate 662. The first upper internal plate 660 and the second upper internal plate 662 may be attached to each of the first and second upper jaws 612*a*, 612*b*. Located between the first lower jaw 614*a* and the second lower jaw 614*b* may be the first lower internal plate 664 and the second lower internal plate 665. The first upper lower plate 664 and the second lower internal plate 665 may be attached to each of the first and second lower jaws 614*a*, 614*b*. The first upper internal plate 660 may be located between the hinge end 605 of the upper jaw structure 602 and the elongated element 628.

The second upper plate 662 may be located between the clamp end 607 of the upper jaw structure 602 and the elongated element 628. The first lower internal plate 664 may be located between the hinge end 608 of the lower jaw structure 604 and the elongated element 628. The second lower plate 665 may be located between the clamp end 609 of the lower jaw structure 604 and the elongated element 628. The first and second upper internal plates 660, 662 may be configured to reduce buckling of the first upper jaw 612*a* and the second upper jaw 612*b* during clamping. The first and second lower internal plates 664, 665 may be configured to reduce buckling of the first lower jaw 614*a* and the second lower jaw 614*b* during clamping.

The clamping apparatus 600 may further include first and second clamping jaw members 616, 618 located at the clamping ends 607, 609, respectively. The first clamping jaw member 616 may be held between the first and second upper jaws 612*a*, 612*b*. The second clamping jaw member 618 may be held between the first and second lower jaws 614*a*, 614*b*. The first and second clamping jaw members 616, 618 may be held between the first and second upper jaws 612*a*, 612*b* and the first and second lower jaws 614*a*, 614*b*, by hinge members 617, 619. The hinge member 617 may be a cylindrical element or pin extending between the first and second upper jaws 612*a*, 612*b* and the first clamping jaw member 616. The hinge member 619 may be a cylindrical element or pin extending between the first and second lower jaws 614*a*, 614*b* and the second clamping jaw member 618. The clamping jaw members 616, 618 may be configured to rotate about the respective hinge members 617, 619.

The clamping apparatus 600 may further include an elongated leverage handle 651 attached to and extending from at least one of the upper jaw structure 602 and the lower jaw structure 604. In the embodiment shown, the elongated leverage handle 651 extends from the first upper jaw 612*a* of the upper jaw structure 602. The elongated leverage handle 651 may extend through each of the first upper jaw 612*a* and the second upper jaw 612*b* through prefabricated openings in each of the upper jaws 612*a*, 612*b*. The elongated leverage handle 651 may be configured to provide an operator (not shown) with a place to hold in order to create leverage when the operator is rotating the elongated element 628 through operation of the tool 699, for example. Each of the first and second lower jaws 614*a*, 614*b* may be fabricated with openings 690 in a mirrored location as to where the elongated leverage handle 651 extend through the first and second upper jaws 612*a*, 612*b*. This may be because the first and second upper jaws 612*a*, 612*b* may be the exact same dimensions as the first and second lower jaws 614*a*, 614*b* and may be fabricated using the same template.

Referring now to FIGS. 33-36, another embodiment of a clamping apparatus 700 is shown. The clamping apparatus 700 may be similar to the clamping apparatus 600 and may share many of the same features as the clamping apparatus 600. For example, the clamping apparatus 700 may include an upper jaw structure 702 having a first upper jaw 712*a* and a second upper jaw 712*b*, a lower jaw structure 704 having a first lower jaw 714*a* and a second lower jaw 714*b*, a hinge 730, an elongated element 728 having an upper threaded end 784, a lower threaded end 782 and an end 780 configured to receive a tool, an elongated leverage handle 751, clamping jaw members 718, 716, upper internal plates 760, 762, and lower internal plates 764, 765. The various features described hereinabove with respect to the clamp 600 may be incorporated into the clamp 700.

Figure 37:
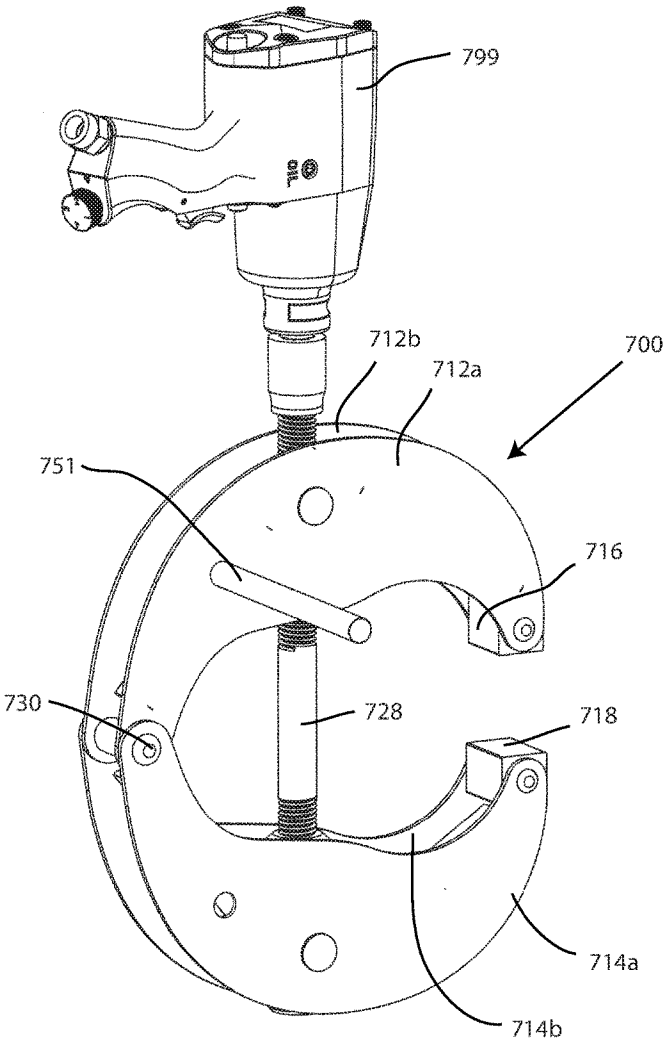
FIG. 37 depicts a perspective view of the clamp of FIGS. 33-36 in the partially open state operated by a powered impact wrench in accordance with one embodiment.

In addition to those shared features, the clamp 700 may include a first nut 770 configured to receive the upper threaded end 784 of the elongated element 728. The clamp may include a second nut 772 configured to receive the lower threaded end 782 of the elongated member. Rather than having circular cross sections, the first and second nuts 770, 772 may each include an elongated structure having a widened portion closer to the outer edges of the upper and lower jaw structures 702, 704. The nuts 770, 772 may include threads closer to the inner edges of the upper and lower jaw structures 702, 704. Within the widened portion of the nuts 770, 772, there may be an opening 791 that may be included. The opening 791 may be a bore, hollow, gap, void or the like. The opening 791 may be configured to receive a safety stop 790. The safety stop 790 may be a widened cross sectional portion having a greater radius than the rest of the elongated element 728. The safety stop 790 may operate in conjunction with the opening 791 and the second nut 772 in order to prevent the upper jaw structure 702 from separating from the lower jaw structure 704 beyond a predetermined amount. This predetermined amount may provide for a distance D between the elongated element 728 and the hinge 730. This distance D may be greater than one inch, for example, in order to prevent a person holding the elongated element from crushing a finger during opening of the clamping apparatus 700 with a power tool such as an impact wrench 799, shown in FIG. 37.

In operation, a method may include placing, by an operator of the clamping apparatus 700, an object between the clamping jaw members 718, 716 while the clamping apparatus 700 is in an open state. The method may include placing the barrel of the impact wrench 799 onto the hexagonally shaped end 780 of the elongated element 728. The method may include holding the elongated leverage handle 751 with one hand and pressing the trigger on the impact wrench 799 with the other by the operator. The method may thereby include placing a high powered torque on the elongated element 728 and quickly rotating the elongated element in a rotational direction configured to cause high speed clamping or moving together of the upper and lower clamping structures 702, 704. During clamping, the method may include preventing buckling by the curved profile of each of the first and second upper jaws 712*a*, 712*b* and the first and second lower jaws 714*a*, 714*b*. The method may further include preventing buckling by the upper internal plates 760, 762 and the lower internal plates 764, 765.

Once clamping is accomplished, when it is time to unclamp the object, the method may include once again placing the barrel of the impact wrench 799 onto the hexagonally shaped end 780 of the elongated member 728. The method may include holding the elongated leverage handle 751 with one hand and pressing the trigger on the impact wrench 799 with the other by the operator. The method may thereby include placing a high powered torque on the elongated element 728 and quickly rotating the elongated element in a rotational direction configured to cause high speed separating of the upper and lower clamping structures 702, 704. The method may include stopping, by the safety stop 790 of the elongated element 728 coming into contact with the boundary of the opening 791 of the nut 772, the over opening or separating of the clamping jaw members 716, 718. The method may thereby include preventing the careless crushing of fingers of the operator during the opening, separating or unclamping of the clamping apparatus 700.

Elements of the embodiments have been introduced with either the articles "a" or "an." The articles are intended to mean that there are one or more of the elements. The terms "including" and "having" and their derivatives are intended to be inclusive such that there may be additional elements other than the elements listed. The conjunction "or" when used with a list of at least two terms is intended to mean any term or combination of terms. The terms "first" and "second" are used to distinguish elements and are not used to denote a particular order.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims. Moreover, it should be understood that the present invention may include any combination of the components, hierarchy and methodology described herein.

What is claimed is:

1. A clamping apparatus comprising:

an upper jaw structure having a hinge end and a clamp end;

a lower jaw structure having a hinge end and a clamp end;

a hinge located at the hinge ends of the upper and lower jaw structures, the hinge providing for rotation of upper jaw structure with respect to the lower jaw structure; and an elongated element threadably attached to the upper jaw structure between the hinge end and the clamp end of the upper jaw structure, wherein rotation of the elongated element in a first direction causes the clamp end of the upper jaw structure to move closer to the clamp end of the lower jaw structure, wherein rotation of the elongated element in a second direction that is opposite to the first direction causes the clamp end of the upper jaw structure to separate from the clamp end of the lower jaw structure, wherein the upper jaw structure includes a C-shaped profile that widens in a middle, wherein a curved inner edge of the C-shaped profile smoothly transitions from a first concave portion to a convex portion and then to a second concave portion, and wherein the convex portion includes a center of curvature located farther from the lower jaw structure than the curved inner edge of the C-shaped profile, wherein the lower jaw structure includes a C-shaped profile, wherein a curved inner edge of the C-shaped profile smoothly transitions from a first concave portion to a convex portion and then to a second concave portion, and wherein the convex portion includes a center of curvature located farther from the upper jaw structure than the curved inner edge of the C-shaped profile.

2. The clamping apparatus of claim 1, wherein the upper jaw structure further comprises:

a first upper jaw; and a second upper jaw, the second upper jaw fixedly coupled to the first upper jaw such that the second upper jaw is spaced apart from the first upper jaw;

and wherein the lower jaw structure further comprises:

a first lower jaw; and a second lower jaw, the second lower jaw fixedly coupled to the first lower jaw such that the second lower jaw is spaced apart from the first lower jaw.

3. The clamping apparatus of claim 2, wherein the first upper jaw and the second upper jaw are parallel plates, and wherein the first lower jaw and the second lower jaw are parallel plates.

4. The clamping apparatus of claim 2, wherein each of the first upper jaw and the second upper jaw have a first C-shaped profile that widens in a middle, wherein a curved inner edge of the first C-shaped profile includes a center of curvature located farther from the first and second lower jaws than the curved inner edge of the first C-shaped profile, and wherein each of the first lower jaw and the second lower jaw have a second C-shaped profile that widens in a middle, wherein a curved inner edge of the second C-shaped profile includes a center of curvature located farther from the first and second upper jaws than the curved inner edge of the second C-shaped profile.

5. The clamping apparatus of claim 2, further comprising:

a first upper internal plate located between and attached to each of the first upper jaw and the second upper jaw;

a first lower internal plate located between and attached to each of the first lower jaw and the second lower jaw.

6. The clamping apparatus of claim 5, further comprising:

a second upper internal plate located between and attached to each of the first upper jaw and the second upper jaw; and a second lower internal plate located between and attached to each of the first lower jaw and the second lower jaw.

7. The clamping apparatus of claim 5, wherein the first and second upper internal plates are configured to reduce buckling of the first upper jaw and the second upper jaw during clamping, and wherein the first and second lower internal plates are configured to reduce buckling of the first lower jaw and the second lower jaw during clamping.

8. The clamping apparatus of claim 7, wherein the first upper internal plate is located between the hinge end of the upper jaw structure and the elongated element and wherein the second upper plate is located between the clamp end of the upper jaw structure and the elongated element, and wherein the first lower internal plate is located between the hinge end of the lower jaw structure and the elongated element and wherein the second lower plate is located between the clamp end of the lower jaw structure and the elongated element.

9. The clamping apparatus of claim 1, wherein, when the clamp end of upper jaw structure is fully separated from the clamp end of the lower jaw structure, the elongated element does not extend from the upper jaw structure and does not extend from the lower jaw structure.

10. The clamping apparatus of claim 9, wherein the elongated element is attached to at least one of the upper and lower jaw structures with a safety stop configured to prevent the upper jaw structure from separating from the lower jaw structure beyond a predetermined amount.

11. The clamping apparatus of claim 1, further comprising an elongated leverage handle attached to and extending from at least one of the upper jaw structure and the lower jaw structure, the elongated leverage handle configured to provide an operator leverage when rotating the elongated element.

12. A clamping apparatus comprising:

a first upper jaw having a hinge end and a clamp end;

a second upper jaw having a hinge end and a clamp end, the second upper jaw fixedly coupled to the first upper jaw such that the second upper jaw is spaced apart from the first upper jaw;

a first lower jaw having a hinge end and a clamp end;

a second lower jaw having a hinge end and a clamp end, the second lower jaw fixedly coupled to the first lower jaw such that the second lower jaw is spaced apart from the first lower jaw;

a hinge located at the hinge ends of the first and second upper jaws and the first and second lower jaws, the hinge providing for rotation of the first and second upper jaws with respect to the first and second lower jaws;

an elongated element threadably attached to the first and second upper jaws between the hinge end and the clamp end of each of the first and second upper jaws, the elongated element threadably attached to the first and second lower jaws between the hinge end and the clamp end of each of the first and second lower jaws, wherein rotation of the elongated element in a first direction causes the clamp ends of the first and second upper jaws to move closer to the clamp ends of the first and second lower jaws; and a first upper internal plate and a first lower internal plate, wherein the first upper internal plate is located between and attached to each of the first upper jaw and the second upper jaw, and extends substantially along a distance that is selected from the distance between the hinge end and the elongated element and the distance between the elongated element and the clamp end, and wherein the first lower internal plate is located between and attached to each of the first lower jaw and the second lower jaw, and extends substantially along a distance that is selected from the distance between the hinge end and the elongated element and the distance between the elongated element and the clamp end.

13. The clamping apparatus of claim 12, wherein the first upper jaw and the first lower jaw are parallel plates, and wherein the first lower jaw and the second lower jaw are parallel plates.

14. The clamping apparatus of claim 12, wherein the first upper internal plate and first lower internal plate are configured to reduce buckling of the first and second upper jaws and the first and second lower jaws during clamping.

15. The clamping apparatus of claim 12, wherein rotation of the elongated element in a second direction that is opposite to the first direction causes the clamp ends of the first and second upper jaws to move away from the clamp ends of the first and second lower jaws, wherein, when the clamp ends of the first and second upper jaws are fully moved away from the clamp ends of the first and second lower jaws, the elongated element does not extend from the first and second upper jaws and does not extend from the first and second lower jaws.

16. The clamping apparatus of claim 15, wherein the elongated element is attached to at least one of the first and second upper jaws and the first and second lower jaws with a safety stop configured to prevent the first and second lower jaws from separating from the first and second upper jaws past a predetermined amount.

17. The clamping apparatus of claim 12, further comprising:

a second upper internal plate, and a second lower internal plate, wherein the first upper internal plate extends between the first upper jaw and the second upper jaw substantially along the distance between the hinge end and the elongated element, the second upper internal plate extends between the first upper jaw and the second upper jaw substantially along the distance between the elongated element and the clamp end, and wherein the first lower internal plate extends between the first lower jaw and the second lower jaw substantially along the distance between the hinge end and the elongated element, the second lower internal plate extends between the first lower jaw and the second lower jaw substantially along the distance between the elongated element and the clamp end.

18. The clamping apparatus of claim 12, wherein the elongated element includes an end extending from at least one of the first and second upper jaws and the first and second lower jaws when the clamp ends of the first and second upper jaws are not fully separated from the clamp ends of the first and second lower jaws, the end configured to receive a tool selected from the group consisting of a hand wrench, an impact wrench, and a ratchet.

19. The clamping apparatus of 18, further comprising an elongated leverage handle attached to and extending from at least one of the first and second upper jaws, the elongated leverage handle configured to provide an operator with leverage when rotating the elongated element.

20. The clamping apparatus of claim 12, wherein each of the first upper jaw and the second upper jaw have a first C-shaped profile that widens in a middle, wherein a curved inner edge of the first C-shaped profile includes a center of curvature located farther from the first and second lower jaws than the curved inner edge of the first C-shaped profile, and wherein each of the first lower jaw and the second lower jaw have a second C-shaped profile that widens in a middle, wherein a curved inner edge of the second C-shaped profile includes a center of curvature located farther from the first and second upper jaws than the curved inner edge of the second C-shaped profile.

21. A clamping apparatus comprising:

an upper jaw structure having a hinge end and a clamp end;

a lower jaw structure having a hinge end and a clamp end;

a hinge located at the hinge ends of the upper and lower jaw structures, the hinge providing for rotation of the upper jaw structure with respect to the lower jaw structure;

an elongated element threadably attached to the upper jaw structure between the hinge end and the clamp end of the upper jaw structure, wherein rotation of the elongated element in a first direction causes the clamp end of the upper jaw structure to move closer to the clamp end of the lower jaw structure, wherein at least one of the upper jaw structure and the lower jaw structure includes a C-shaped profile that widens in a middle, wherein if the C-shaped profile is included in the upper jaw structure:

a curved inner edge of the C-shaped profile smoothly transitions from a first concave portion to a convex portion and then to a second concave portion, and the convex portion includes a center of curvature located farther from the lower jaw structure than the curved inner edge of the C-shaped profile, and wherein if the C-shaped profile is included in the lower jaw structure:

a curved inner edge of the C-shaped profile smoothly transitions from a first concave portion to a convex portion and then to a second concave portion, and wherein the convex portion includes a center of curvature located farther from the upper jaw structure than the curved inner edge of the C-shaped profile.

22. The clamping apparatus of claim 21, wherein the elongated element comprises a first elongated element and a second elongated element, the clamping apparatus further comprising a turnbuckle drive extending between the upper jaw structure and the lower jaw structure, the turnbuckle drive configured to expand and contract the first and second elongated elements when rotated.

* * * * *